US005521573A

United States Patent [19]

Inoh et al.

[11] Patent Number: 5,521,573

[45] Date of Patent: May 28, 1996

[54] PRINTED COIL

[75] Inventors: Kiyoharu Inoh; Hisanaga Takano, both of Tokyo, Japan

[73] Assignee: Yokogawa Electric Corporation, Tokyo, Japan

[21] Appl. No.: 316,315

[22] Filed: Sep. 30, 1994

[51] Int. Cl.[6] ..... H01F 27/28

[52] U.S. Cl. ..... 336/180; 336/84 C; 336/182; 336/183; 336/200

[58] Field of Search ..... 336/200, 232, 336/180, 182, 183, 84 C, 84 R; 29/602.1

[56] References Cited

U.S. PATENT DOCUMENTS 4,873,757 10/1989 Williams ..... 29/602.1

FOREIGN PATENT DOCUMENTS 267108 5/1988 European Pat. Off. ..... 336/200
3-183106 8/1991 Japan ..... 336/200
5-135968 6/1993 Japan ..... 336/200
5-205943 8/1993 Japan ..... 336/200
1116161 6/1968 United Kingdom ..... 336/200

*Primary Examiner*—Thomas J. Kozma
*Attorney, Agent, or Firm*—Moonray Kojima

[57] ABSTRACT

A printed coil, having good magnetic coupling, low loss, and good high frequency characteristics, comprises a plurality of conductor forming planes on which a conductor pattern having one or more turns are formed centered about a core inserting hole and which are laminated together with an insulating layer, each of the conductor forming planes being provided with outer peripheral connecting holes provided on an outer periphery of the conductor pattern, and a plurality of inner peripheral connecting holes provided on an inner periphery thereof, with the outer and inner peripheral connecting holes being connected to the conductor pattern; a connecting coil which is laminated together with the conductor forming planes and having a connection pattern thereon for connecting the outer and inner peripheral connecting holes, and circuitry for electrically connecting the outer and inner peripheral connecting holes and the connecting coil.

8 Claims, 25 Drawing Sheets

PRINTED COIL

BACKGROUND OF THE INVENTION

1. Field of Invention

This invention relates to a coil structure, and more particularly to a printed coil having improved magnetic coupling, low loss and improved high frequency characteristics, when used as a transformer.

2. Description of the Prior Art

Transformers are widely known and are used as a magnetic component for electronic devices and power units. The conventional transformer comprises an insulator gap between a primary coil and a secondary coil, and the voltage generated in the secondary coil is determined by the voltage applied to the primary coil multiplied by the winding ratio therebetween.

FIG. 1 is a partially cut-away perspective view of a conventional transformer, wherein bobbin 1 is molded by an insulator resin or the like, and ring shaped collar sections 1*b* are created at both ends of a tubular cylindrical section 1*a*. Winding section 2 comprises conductive wires 2 wound around cylindrical section 1*a* of bobbin 1, wherein a primary winding 2*a* and secondary winding 2*b* form a double layer with an insulating tape disposed therebetween. Barriers 4 are provided in bobbin 1 in order to form a gap between windings 2 and collar section 1*b* to satisfy safety standards, and are constructed by winding two layers of tape shaped insulator with insulating tape 3 therebetween. A core 5, which may be an EE type core, is made of magnetic material and has a middle leg 5*b*, which penetrates through cylindrical section 1*a* of bobbin 1, and two outer legs 5*a* positioned on both sides of middle leg 5*b*. A closed magnetic path is formed by combining two of the EE type cores 5 to improve electromagnetic coupling of the transformer.

However, because wire 2 is wound around cylindrical bobbin 1 in the conventional transformer, there are problems, such as, the winding operation is cumbersome and the device is physically large since bobbin 1, which comprises most of the volume of the transformer, is itself large. Furthermore, barriers 4 are needed because insulation must be fully maintained at the lateral ends of the winding 2 in order to satisfy safety standards. Also, because the radial surroundings of winding 2 are not covered by an insulator, a gap must be provided for insulation.

A device which uses a simplified winding operation is disclosed in Japan UM Laid-Open No. 4/46,524, and is shown in FIGS. 2A and 2B, wherein FIG. 2A depicts a sectional view, and FIG. 2B depicts a perspective view, of a simplex stack bobbin 6. Several stack bobbins 6 are laminated together and a core 5 is attached thereto and form a transformer. A plate insulating barrier 7 is attached at the boundary between the primary side and secondary side of stack bobbins 6. Insulating covers 8 are attached to the outsides of stack bobbins 6.

Stack bobbin 6 has a plate 6*a* which is a partition between the layers of windings 2 and a cylindrical magnetic core section 6*b* having a rectangular opening provided at the center of plate 6*a*. Two pull out guide sections 6*c* are provided at both ends of the lower end of plate 6*a* to keep plate 6*a* at a predetermined position. A pin section 6*d* is provided on the pull out guide section 6*c*, which is soldered to a printed board (not shown), and forms a terminal to which winding 2 is connected. When plates 6*a* are to be stacked, they may be disposed in a telescopic manner so that pull out guide sections 6*c* will not interfere with each other.

Winding 2 is wound about magnetic core section 6*b* and both ends thereof are connected to pin sections 6*d*. Core 5 has a middle leg 2 which is disposed through magnetic core sections 6*b*.

The winding operation involves running the wire along plate 6*a* and about magnetic core section 6*b*. Thus, as compared to the case where winding 2 is wound around a cylindrical bobbin, such as in FIG. 1, the winding operation is simplified.

However, because the lateral and radial surroundings of winding 2, are not covered by an insulator, a gap necessary to provide insulation is needed. Thus, as with FIG. 1, the problem of size of the transformer remains. Furthermore, because the number of pin sections 6*d* increases corresponding to the number of laminations of the stack bobbins 6, when a telescopic structure is adopted for the pull out guide section 6*c*, the winding operation for wiring around each pin section 6*d* or for wiring between each pin section 6*d*, becomes complicated.

Moreover, because the primary coil and secondary coil are separately laminated on stack bobbins 6, only the plane on which insulating barrier 7 is provided becomes the magnetic coupling plane of the primary and second windings, thereby increasing leakage inductance and degrading magnetic coupling between the primary winding and the secondary winding. Moreover, effective AC resistance significantly increases by the so-called proximity effect when there is a conductor in which a high frequency current flows in the same direction. Also, resistance increases when the winding direction on each plate of the stack bobbins 6 is such that current flows in the same direction.

As for floating capacity, there is a problem between adjacent plates of the stack bobbins 6. If a commercial power source is connected to the primary side, the voltage on the primary side is 100V to 220V and if the secondary side is used for driving a logic circuit, its voltage is 5V to 15V. That is, the primary voltage is higher than the secondary voltage by a factor of about one digit, that is a factor of 10. Because electrostatic energy is proportional to the square of voltage,the floating capacity of stack bobbins 6, used as the primary coil, becomes 100 times that of the secondary coil, if the transformation ratio of the transformer is 10:1.

SUMMARY OF THE INVENTION

Accordingly, a first object of the invention is to provide a small, low cost device wherein the area surrounding the winding thereof is readily filled with an insulator and wherein any gap necessary for insulation is reduced.

A second object is to provide a device wherein the operation for connecting each terminal thereof is simply and easy to accomplish even when the number of laminated coils is increased.

A third object is to provide a coil having improved magnetic coupling, low loss, and high frequency characteristics when used as a transformer.

A fourth object is to provide a device which generates less noise and has a good shielding characteristic when used as a switching power source.

The foregoing first through third objects are attained in a first aspect of the invention which encompasses a printed coil comprising a plurality of conductor forming planes, on which a conductor pattern having one or more turns are formed centering on a core inserting hole, laminated together with an insulating layer;

each of the conductor forming plates being provided with outer peripheral connecting holes provided on an outer periphery of the conductor pattern and a plurality of inner peripheral connecting holes provided on an inner periphery thereof, the outer and inner peripheral connecting holes being connected to the conductor pattern on the conductor forming planes; a connecting coil, laminated to the conductor forming planes and having a connection pattern for connecting the outer and inner peripheral connecting holes; and means for electrically connecting the outer and inner peripheral connecting holes and connecting coil.

In the above aspect of the invention, both ends of each connector pattern are connected to the outer and inner peripheral connecting holes and a connection is made from the inner peripheral connecting hole to the outer peripheral connecting hole on the connecting coil by the connection pattern. The foregoing is then connected to the wiring of a printed board via terminals attached to the outer peripheral connecting holes and the through hole. Because the conductor pattern of each plate coil is connected through the inner and outer peripheral connecting holes, the degree of freedom of the disposition of the coils is improved, thereby allowing the coils to be flexibly disposed so that the magnetic coupling is improved, the loss is less, and high frequency characteristic is improved. Also, because the connection of each conductor pattern may be changed readily, as desired, even on the same plane coil by appropriately selecting the desired connection pattern on the connecting coil, the device can be readily mass produced.

The first and third objects are attained in a second aspect of the invention which encompasses a printed coil comprising a plurality of conductor forming planes, on which a conductor pattern having one or more turns are formed centering on a core inserting hole, laminated together with an insulating layer; each of the conductor forming planes being provided with outer peripheral connecting holes provided on the outer periphery of the conductor pattern and a plurality of inner peripheral connecting holes provided on the inner periphery thereof, the outer and inner peripheral connecting holes being connected to the conductor pattern on the conductor forming planes; and means for electrically connecting the outer and inner peripheral connecting holes.

According to the second aspect of the invention, the secondary coil is disposed between the primary coils so that magnetic coupling between the primary winding and the secondary winding is improved, leakage inductance is reduced, increase of resistance caused by the proximity effect is suppressed, and floating capacity is reduced.

The first, third and fourth objects are attained by a third aspect of the invention which encompasses a printed coil type transformer comprising a primary coil means comprising a conductor pattern having a primary winding of a transformer; a secondary coil means comprising a conductor pattern having a secondary winding of the transformer; the primary winding and secondary winding being grounded to independent AC grounds and the transformer polarity of the primary winding and the secondary winding being opposite; and a third coil means comprising a conductor pattern, one end of which is grounded to the AC ground, and whose transformer polarity coincides with that of the secondary winding, and wherein the third coil means further comprises a conductor winding layer on which the voltage of the conductor pattern of the third coil means generated by AC voltage applied to the primary winding almost coincides with the voltage generated on the secondary winding.

According to the third aspect of the invention, the transformer polarity of the conductor patterns on the primary and secondary coils means are opposite. The third coil means is inserted as one having a transformer polarity of the secondary coil means between the two coil means and allocates a region where the voltage of the secondary coil means almost coincides with the AC voltage. Accordingly, the potential difference between opposed layers becomes small thereby hampering flow of noise current and reducing noise. The latter effects are desired in a transformer.

BRIEF DESCRIPTION OF THE DRAWINGS

FIGS. 4A and 4B depict a printed coil laminate wherein FIG. 4A depicts a top plan view, and FIG. 4B depicts a sectional view.

DETAILED DESCRIPTION OF PREFERRED EMBODIMENTS

Figure 1:
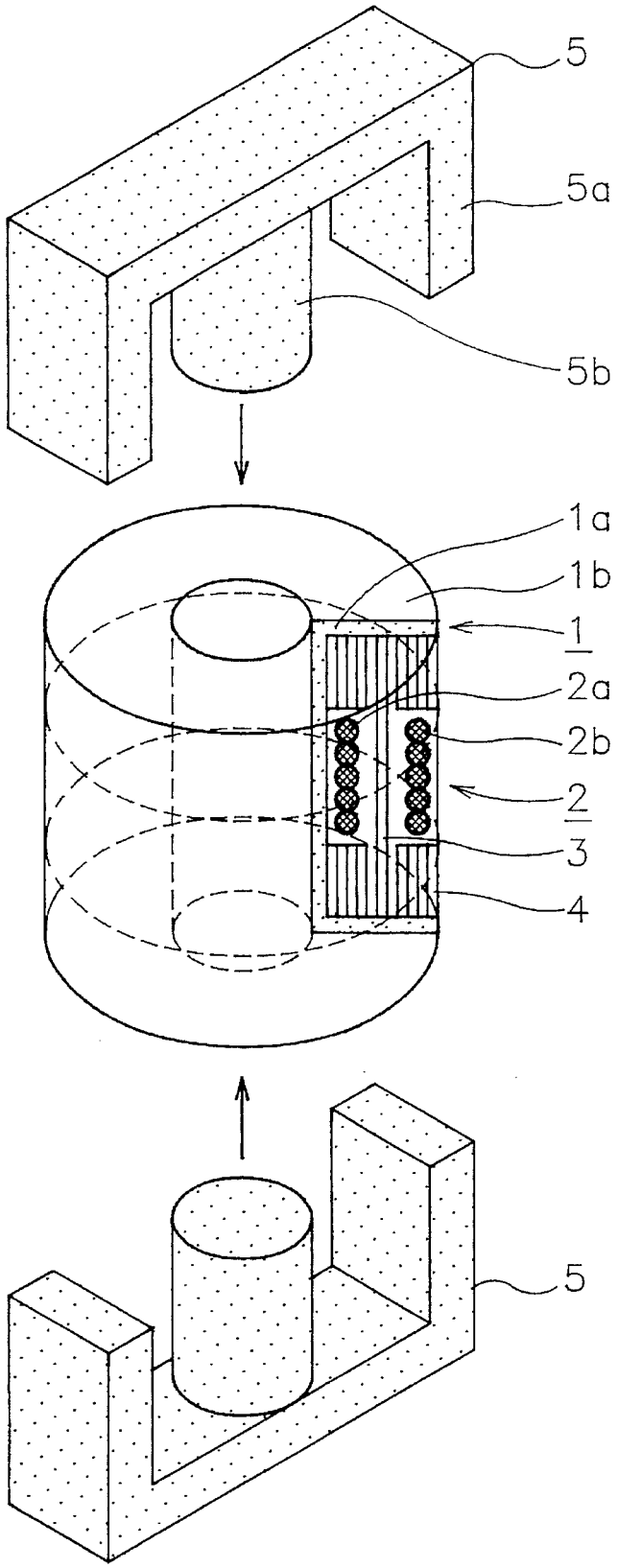
Fig. 1 (Prior Art)
FIG. 1 is a perspective view depicting a conventional transformer using a bobbin.
Figure 2B:
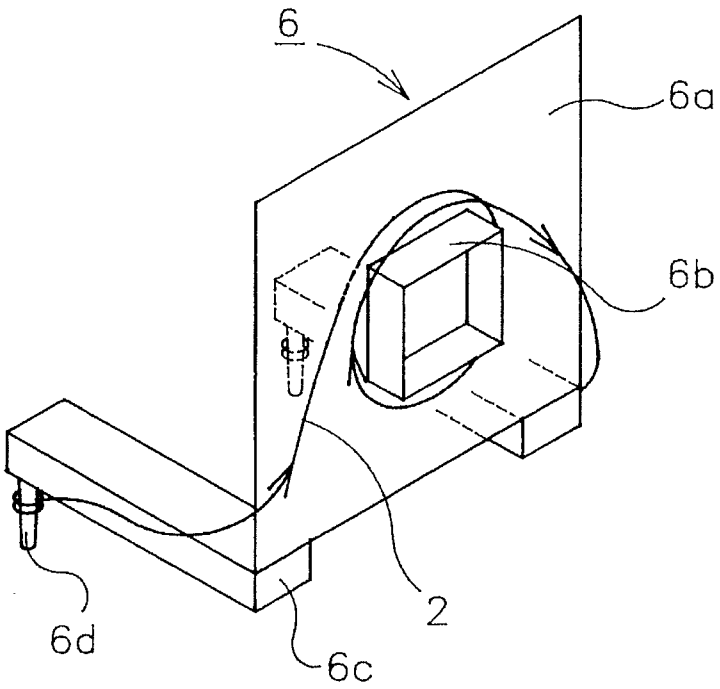
Fig.2(B)(Prior Art)
FIGS. 2A and 2B are views depicting another conventional device.
Figure 2A:
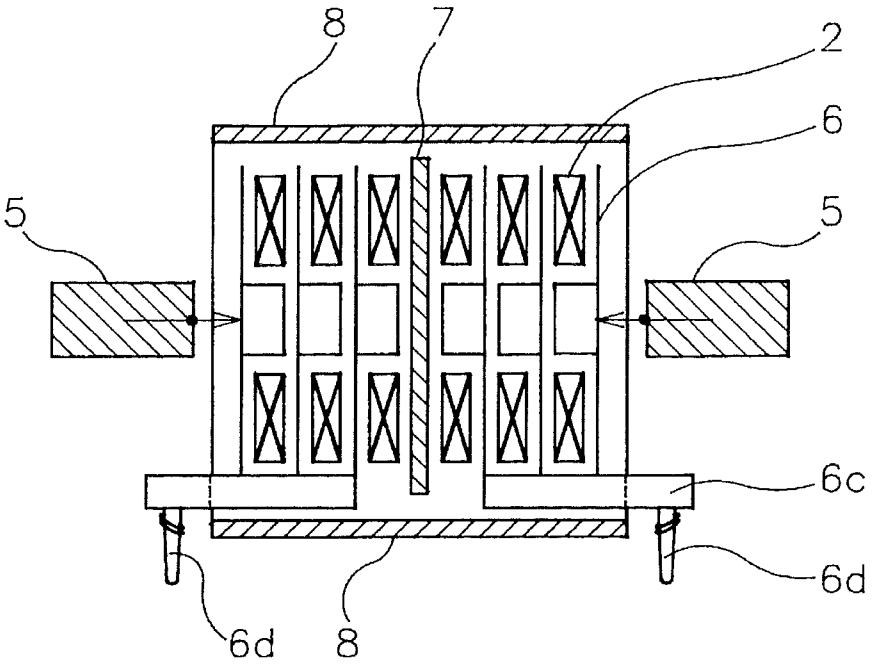
Fig.2(A)(Prior Art)

Referring now to the drawings, in FIG. 1, a pair of cores 30, which can be of the so-called EE shape, have two end sections 31 of a rectangular shape and a middle leg section 32 of a circular shape. A connecting section 33 connects the end sections 31 and middle leg section 32, and has a rectangular shape.

Terminals, including primary terminals 41, secondary terminals 42, and inner peripheral terminals 43, are used to connect signal lines on the primary and secondary sides when a transformer is assembled. While at least two each of the primary terminals 41 and secondary terminals 42 are desired, the numbers may be increased corresponding to the number of printed coil laminates 50. Furthermore, the number of inner peripheral terminals 43 may be determined corresponding to the number of printed coil laminates 50 and to the type of connection, and 6 terminals are provided in this example centered about core inserting hole 56, as depicted.

The plate printed coil laminate 50 performs the functions of the primary and secondary windings of a transformer and forms a magnetic circuit when the middle leg section 32 is inserted in core inserting hole 56 provided at the center thereof, and the end sections 31 are positioned correspondingly on the outside with connecting sections 33 sandwiching plate 50. The connecting section 33 of core 30 is positioned at the center of the surface of the printed coil laminate 50 and primary terminal 41 and secondary terminal 42 are positioned on both sides thereof.

Figure 4A:
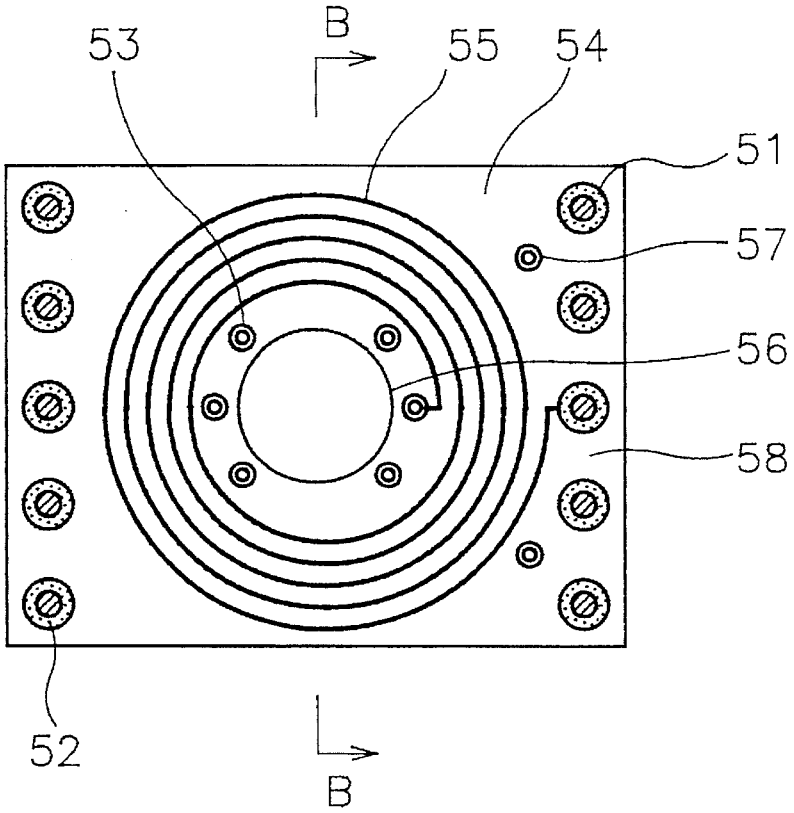
Figure 4B:
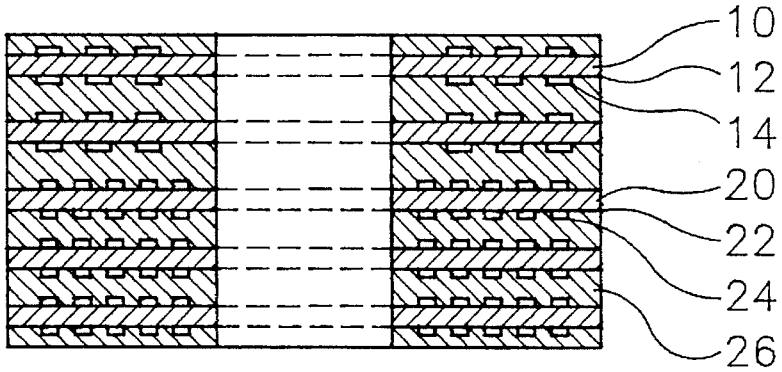

FIGS. 4A and 4B show the structure of printed coil laminate 50, with FIG. 4A showing a top plan view, and FIG. 4B showing a sectional view taken along section line B—B. The printed coil laminate 50 may comprise a plurality of plate coils 58 laminated together. The core inserting hole 56 is provided at the center and five primary outer peripheral connecting holes 51 and five secondary outer peripheral connecting holes 52 are provided in a row on both ends of plate coil 58. Six inner peripheral connecting holes 53 are provided near hole 56. Two interlayer connecting holes 57 are provided near the primary outer peripheral connecting hole 51 and are used when the inner peripheral connecting holes 53 are not sufficient for interlayer connection between each plate coil 58.

Figure 3:
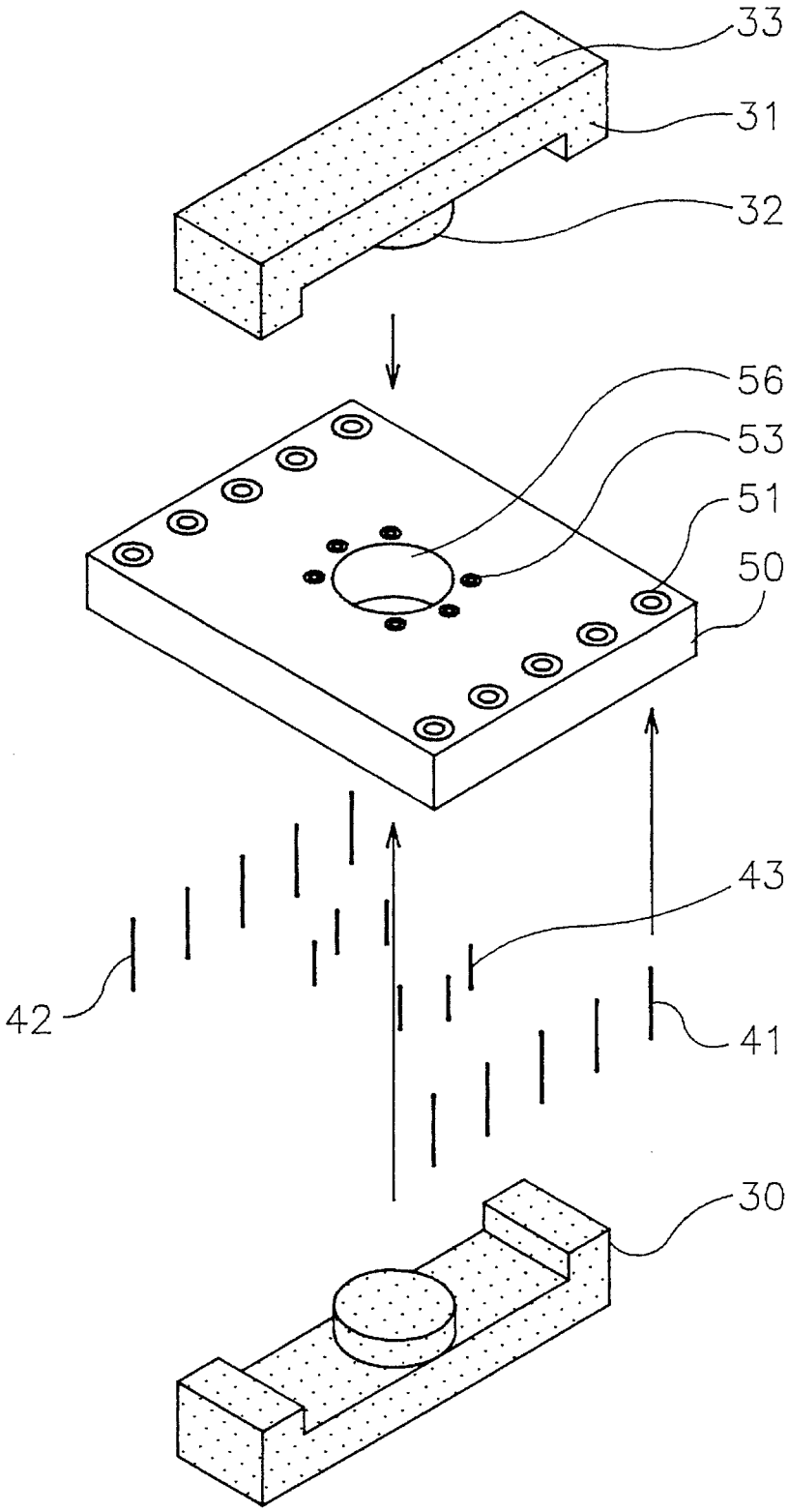
FIG. 3 is a perspective view depicting a first illustrative embodiment of the invention.

After laminating plate coil 58, primary terminal 41 (see FIG. 3) is soldered to primary outer peripheral connecting hole 51, secondary terminal 42 is soldered to secondary outer peripheral connecting hole 52 and inner peripheral terminal 43 is soldered to inner peripheral connecting hole 53. Primary terminal 41, secondary terminal 42 and inner peripheral terminal 43 are made from a short metallic rod, such as of copper, which is suitable for soldering. Primary terminal 41 and secondary terminal 42 have a length which reaches printed board 20 and inner peripheral terminal 43 has a length which is the thickness of the printed coil laminate 50. When interlayer connecting hole 57 is used, the same terminal with inner peripheral terminal 43 is attached thereto. A conductor forming plane 54 is an area located between core inserting hole 56, primary outer peripheral connecting hole 51, and secondary outer peripheral connecting hole 52, and on which area a spiral conductor pattern 55 is formed.

Conductor pattern 55 is formed on both sides or on one side of the plate coil 58. In FIG. 4B, the conductor patterns 55 are formed on both sides. In the case of the primary coil 10, in which conductor pattern 55 has the function of a primary winding, one end thereof is connected to primary outer peripheral connecting hole 51 and the other end is connected to inner peripheral connecting hole 53. In the case of the secondary coil 20, in which plate coil 58 has the function of a secondary winding, one end thereof is connected to secondary outer peripheral connecting hole 52, and the other end thereof is connected to inner peripheral connecting hole 53.

Referring now to FIG. 4B, which shows the laminated structure of a plurality of plate coils 58, primary coil 10 is formed on both sides of a base plate 12 using wiring patterns 14. Secondary coil 20 is formed on both sides of base plate 22 using wiring patterns 24. Two sheets of base plate 12 are laminated and below that, three sheets of base plate 22 are laminated. Insulative resin 26 is filled between each base plate 12 and 22. Thus, wiring patterns 14 and 24, which have the same functions as conventional windings, are coated with the insulator resin 26. As a result, the gap necessary for satisfying safety standards is obtained and is shortened.

Figure 5:
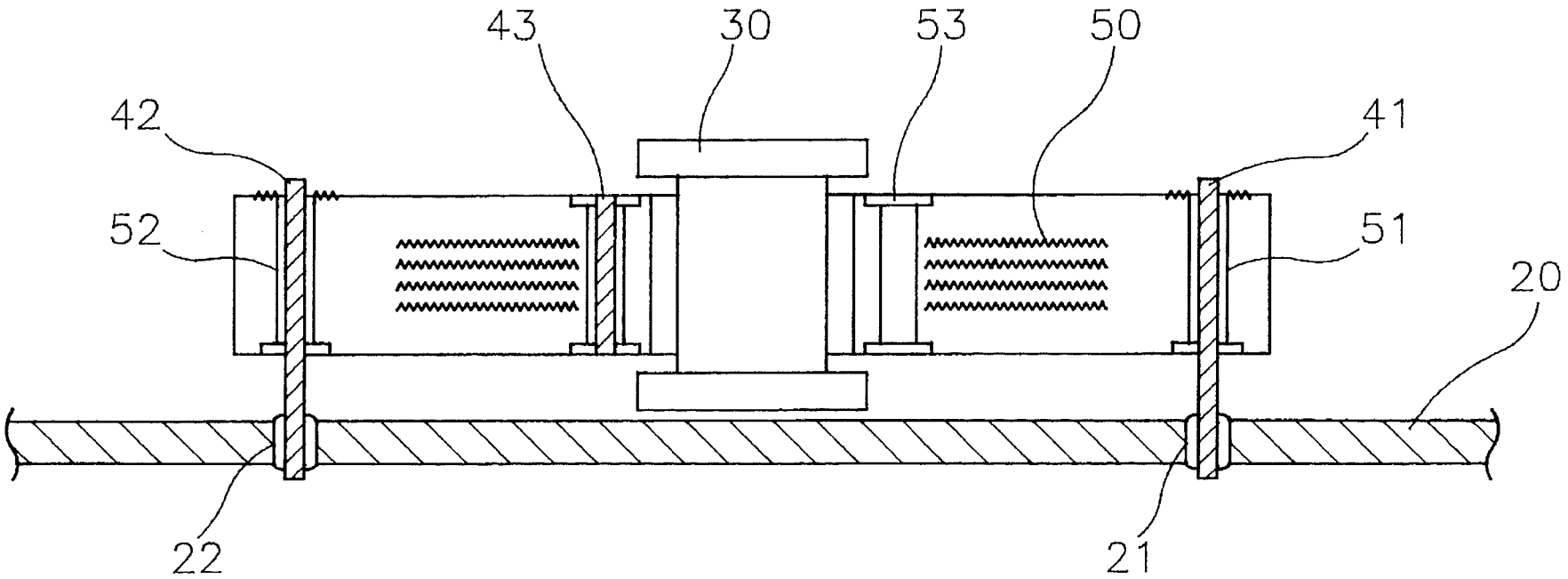
FIG. 5 is a sectional view depicting a printed coil type transformer packaged on a printed board.

FIG. 5 shows a printed coil type transformer on a printed board, wherein, a primary through hole 21 and secondary through hole 22 are provided on printed board 20. When printed coil laminate 50 is packaged on the printed board 20, primary terminal 41 and secondary terminal 42 are soldered to the primary winding through hole 21 and to the secondary winding through hole 22.

Primary terminal 41, secondary terminal 42 and inner peripheral terminal 43 are disposed so that the insulation distance needed to satisfy safety standards is maintained, that is by maintaining the spatial distance between these terminals and conductor pattern 55 on conductor forming plane 54. Each of terminals 41, 42 and 43 is disposed by providing the outer peripheral connecting holes 51 and 52 and inner peripheral connecting holes 53, at the outer and inner peripheries of the spiral conductor pattern 55, by inserting primary terminal 41 into primary outer peripheral connecting hole 51, by inserting secondary terminal 42 into secondary outer peripheral connecting hole 52, and by inserting inner peripheral terminal 43 into inner peripheral connecting hole 53. Accordingly, extra spatial distance is not needed on the conductor forming plane 54. This allows the maximum use of the coil area. Accordingly, magnetic coupling, which is proportional to the coil area, is maximized, and magnetic coupling between the coils is greatly improved.

Figure 6:
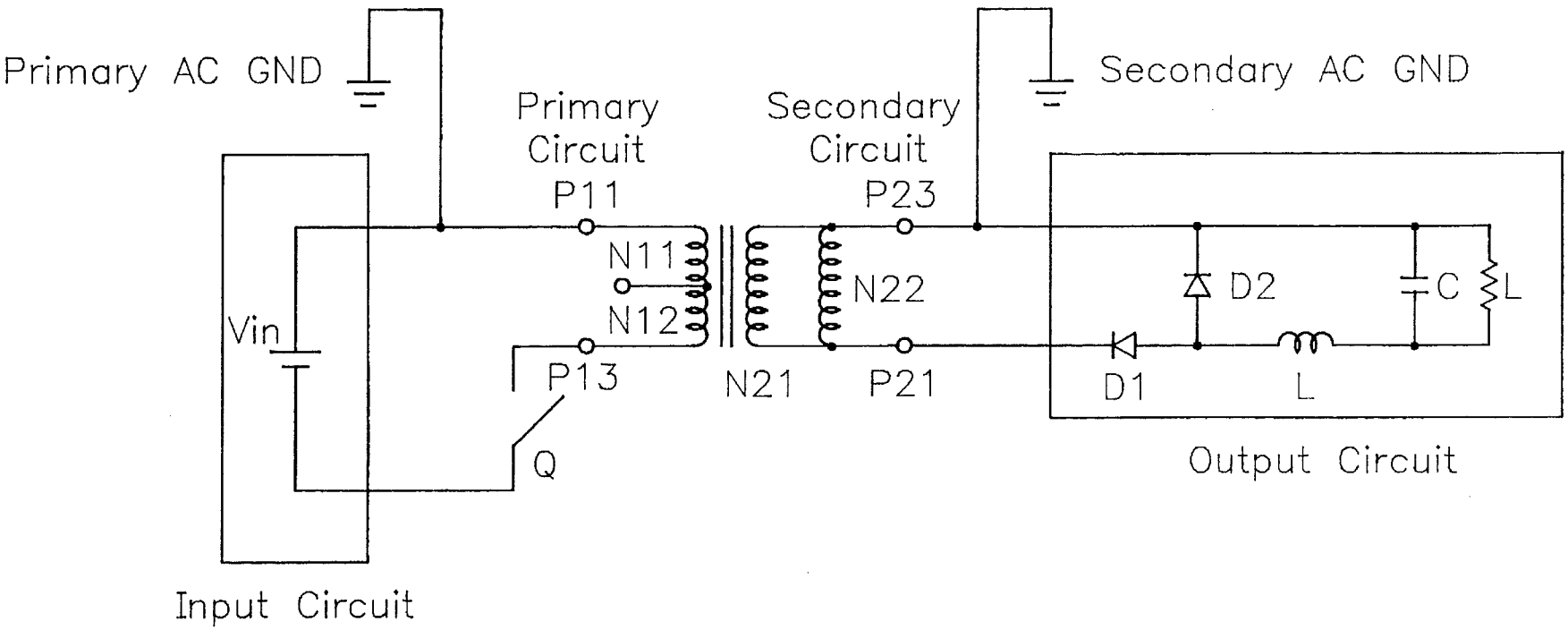
FIG. 6 is a circuit diagram depicting a printed coil type transformer packaged as a switching power source.

FIG. 6 shows the circuit diagram of a printed coil type transformer packaged on a switching power source, wherein, a DC power Vin is applied to the primary winding and is turned ON and OFF by a switching element Q. A switching signal is induced on the secondary winding and is sent to an output circuit containing diodes D1 and D2, choking coil L and capacitor C to supply rectified and smoothed DC voltage to a load L. In the primary winding, a primary coil N11 and primary coil N12, are connected in series. In the secondary winding, a secondary coil N21 and secondary coil N22, are connected in parallel. Furthermore, a terminal P11 is connected to DC power source Vin and a terminal P13 is connected to switching element Q. Terminals P21 and P23 connect both ends of secondary coils N21 and N22 to the output circuit.

Figure 7:
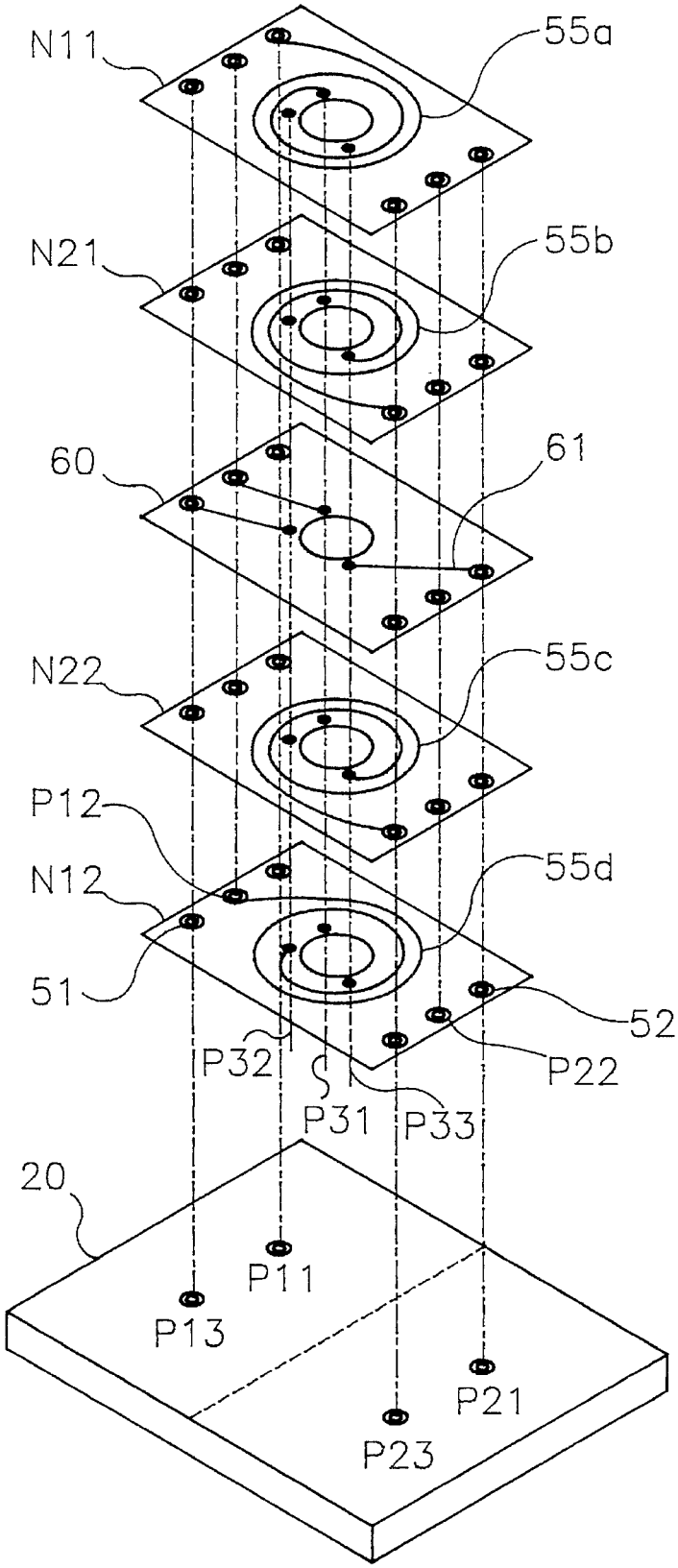
FIG. 7 is a perspective view depicting connection of the conductor patterns of the plate coils of the circuit of FIG. 6.

Connection of the conductor patterns of the plate coils of FIG. 6 may be explained with reference to FIG. 7, wherein the plate coils on which the conductor pattern is formed are shown with the patterns being only one one side. In FIG. 7, secondary coils N21 and N22 are disposed between primary coils N11 and N12 and coil N12 faces printed board 20. A connection coil 60 is provided between the secondary coils N21 and N22. Primary coils N11 and N12 have spiral conductor patterns 55*a* and 55*d* with two turns starting at the primary outer peripheral connecting hole 51 and extending to the inner peripheral connecting hole 53. Conductor pattern 55*a* is connected to primary outer peripheral connecting hole 51, which corresponds to terminal P11, and to inner peripheral connecting hole 53, which corresponds to terminal P31. Conductor pattern 55*d* is connected to the primary outer peripheral connecting hole 51, which corresponds to terminal P12, and to inner peripheral connecting hole 53, which corresponds to terminal P32.

Secondary coils N21 and N22 have spiral conductor patterns 55*b* and 55*c* with two turns starting at the secondary outer peripheral connecting hole 52 and extending to the inner peripheral connecting hole 53. Conductor pattern 55*b* is connected to secondary outer peripheral connecting hole 52, which corresponds to terminal P23, and to inner peripheral connecting hole 53, which corresponds to terminal P33. Conductor pattern 55*c* is connected to secondary outer peripheral connecting hole 52, which corresponds to terminal P23, and to inner connecting hole 53, which corresponds to terminal P33. Necessary or desired connections are provide by connection patterns 61 on connecting coil 60. Terminals P11 and P13 are disposed on the primary circuit side and terminals P21 and P23 are disposed on the secondary circuit side of printed board 20.

Figure 8:
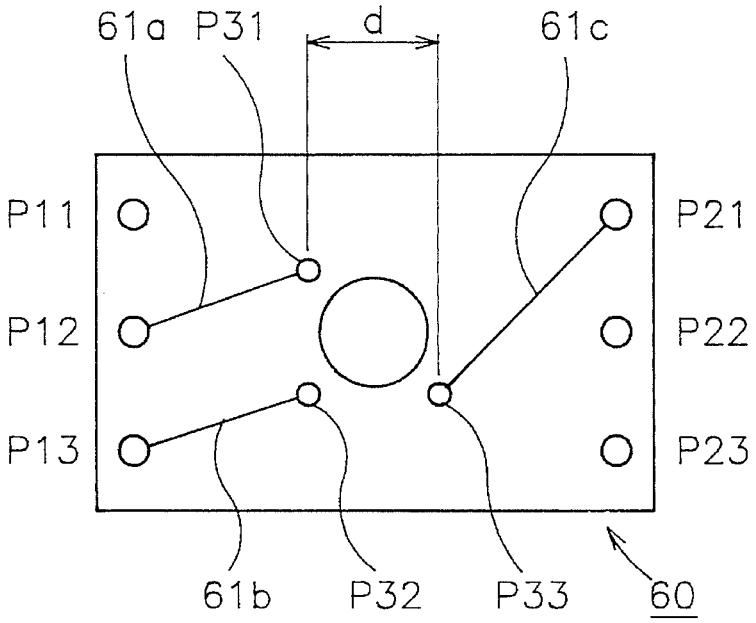
FIG. 8 is a diagram depicting the connection pattern of a connecting coil.

The connection pattern 61 on the connecting coil 60 is further explained with reference to FIG. 8, wherein on the primary side, terminals P12 and P13 are connected by connection pattern 61*a* and terminals P13 and P32 are connected by connection pattern 61*b*. On the secondary side, terminals P21 and P33 are connected by connection pattern 61*c*. By these connections, the coils are connected in series on the primary side and the coils are connected in parallel on the secondary side, as shown in FIG. 6. Concerning inner peripheral connecting hole 53, terminals P31 and P32, which are connected to the primary coils N11 and N12, are provided at the region close to terminals P11 through P13, on the primary side, and terminal P33, which is connected to secondary coils N21 and N22, are provided at the region close to terminals P21 through P23, on the secondary side. Because a gap "d" between terminals P31 and P32 and terminal P33, is equivalent to an insulation distance between the primary and secondary, it is favorable to thus dispose the terminals separately on the primary side and the secondary side, about the inner peripheral connecting hole 53, as the insulation distance increases.

Figure 9A:
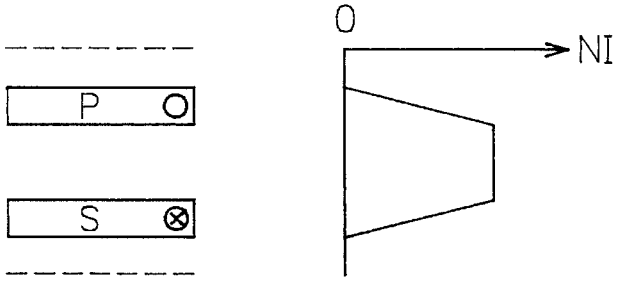
FIGS. 9A and 9B are views depicting NI distribution in the thickness direction of the coil laminate.
Figure 9B:
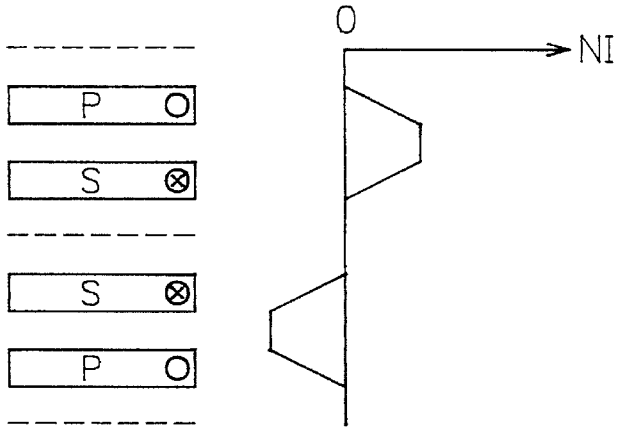

The NI distribution can be best understood with reference to FIGS. 9A and 9B, wherein FIG. 9A shows primary coil P and secondary coil S as laminated, and FIG. 9B shows the secondary coil S being disposed between primary coils P. Generally,leakage flux is proportional to the product NI of current I within the coils and the number of coil windings N. Accordingly, because the distribution of leakage flux exists within the coils and the leakage flux becomes significant when the NI is large, AC resistance of the coils increases. When primary coil P and secondary coil S are laminated together, NI becomes zero and the leakage flux also becomes zero at the outermost layer of the coil. Accordingly, when connecting coil 60 is placed at the outermost layer, AC resistance in the connecting coil is reduced. When secondary coils S are disposed between the primary coils P, NI becomes zero and the center and at the outer most layers. Then, AC resistance in the connecting coil 60 is reduced by providing the connecting coil 60 at the center layer or at the outermost layer. This is advantageous because the shield effect may be obtained electrostatically when the connecting coil 60 is provided on the outermost layer.

Figure 10A:
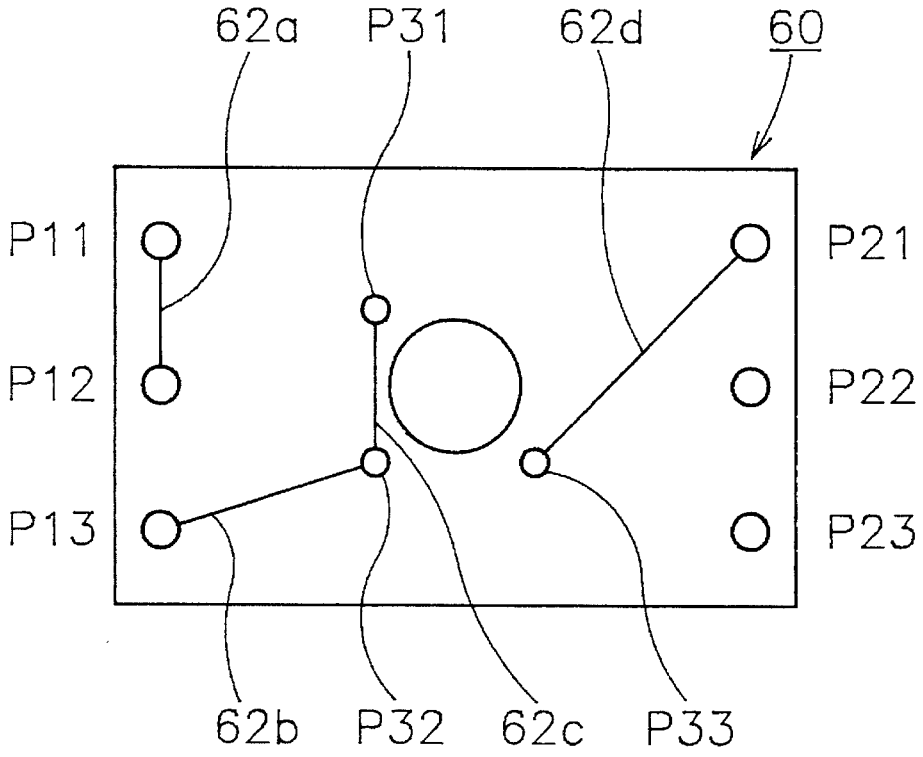
FIGS. 10A and 10B are views depicting another connection pattern of the connecting coil.
Figure 10B:
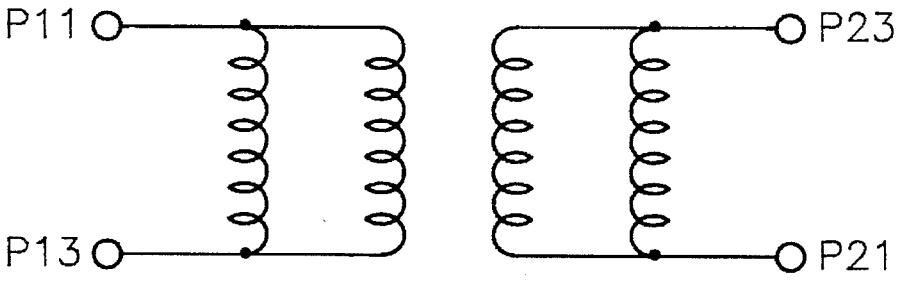

Another connection pattern 61 of the connecting coil 60 may be explained with reference to FIGS. 10A and 10B, wherein FIG. 10A is a plan view of connecting coil 60, and FIG. 10B is a connection diagram of the coil 60. On the primary side, terminals P11 and P12 are connected by a connection pattern 62*a*, terminals P13 and P32 are connected by a connection pattern 62*b*, and terminals P31 and P32 are connected by a connection pattern 62*c*. On the secondary side, terminals P21 and P33 are connection by connection pattern 62*d*. The coils are connected in parallel on the primary side, and the coils are connected also in parallel on the secondary side (see FIG. 10B). Thus, various connections may be selected, even on the same coil laminate by selecting a connection pattern of the connecting coil 60.

Figure 11B:
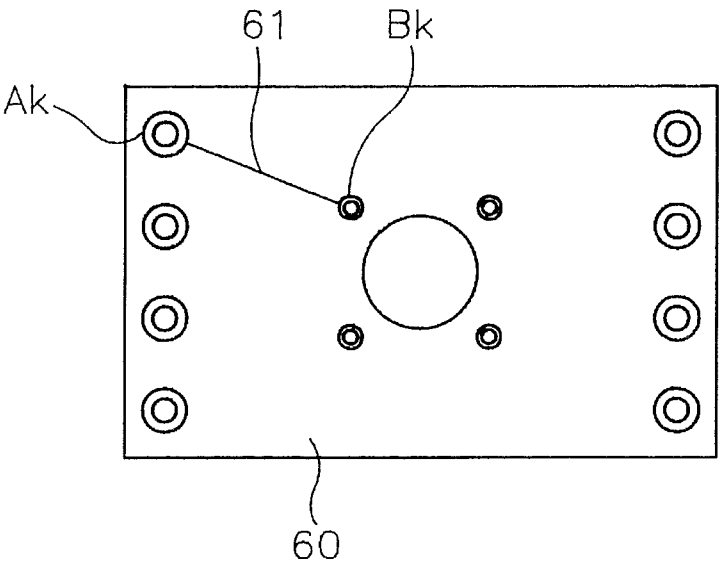
FIGS. 11A and 11B are views depicting the wiring of the connecting coil on the printed coil laminate.
Figure 11A:
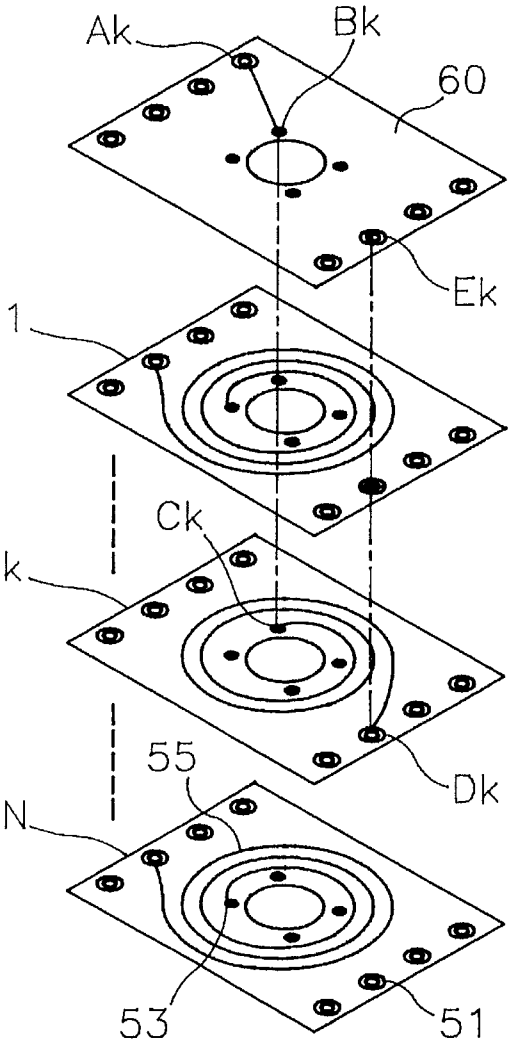

The wiring of connecting coil 60 on the printed coil laminate 50 will now be explained with reference to FIGS. 11A and 11B, wherein FIG. 11A is a perspective view of the laminating structure, and FIG. 11B is a top plan view of connecting coil 60. The connecting coil 60 is placed as the top layer and under that, conductor forming planes 54 of the first layer, . . . the k-th layer, . . . the N-th layer are laminated. On the k-th layer conductor forming plane 54, a starting terminal Ck is provided at one of the inner peripheral connecting holes 53, and an ending terminal Dk is provided at one of the primary outer peripheral connecting holes 51, and a spiral conducting pattern 55 is connected between the starting terminal Ck and the ending terminal Dk. Correspondingly, on connecting coil 60, a starting terminal Bk is provided at one of the inner peripheral connecting holes 53, corresponding to the starting terminal Ck, and an ending terminal Ek is provided at one of the primary outer peripheral connecting holes 51, corresponding to the ending terminal Dk. Because the starting terminal Bk uses inner peripheral connecting hole 53, it is inconvenient to connect the device with the outside. One of the primary outer peripheral connecting hole 51 is allocated for a terminal Ak for connecting with the outside, and terminal Ak for connecting with the outside and starting terminal Bk are connected by a radial connection pattern 61 (see FIG. 11B).

When there are N layers of the conductor forming planes 54, N starting terminals Bk are provided at the center portion of the connecting coil 60 and 2N terminals of the terminals Ak and ending terminals Ck are provided at a maximum at the peripheral portion. Because each of the conductor forming planes 54 is independent, the peripheral terminal Dk may be provided at an arbitrary position and the peripheral terminal Ek may be provided at a position corresponding thereto.

Connection between the coils, such as serial, parallel and branch connections, are made by the mutual connection among terminals Ai, Bj and Ek (i, j, k=1, . . . n). Because terminals Ak, and starting terminal Bk and peripheral terminal Ek, which correspond to starting terminal Ck and ending terminal Dk, on each of the planes 54, are provided on connecting coil 60, N conductor forming planes 54 may be connected from the starting terminal to the ending terminal at an arbitrary position, whereby the degree of freedom of the coil connection is increased. Furthermore, because a plurality of connection relationships of each conductor pattern may be realized on the same conductor forming plane 54 by appropriately selecting the connection pattern on the connecting coil 60, mass-productivity is enhanced.

Figure 12:
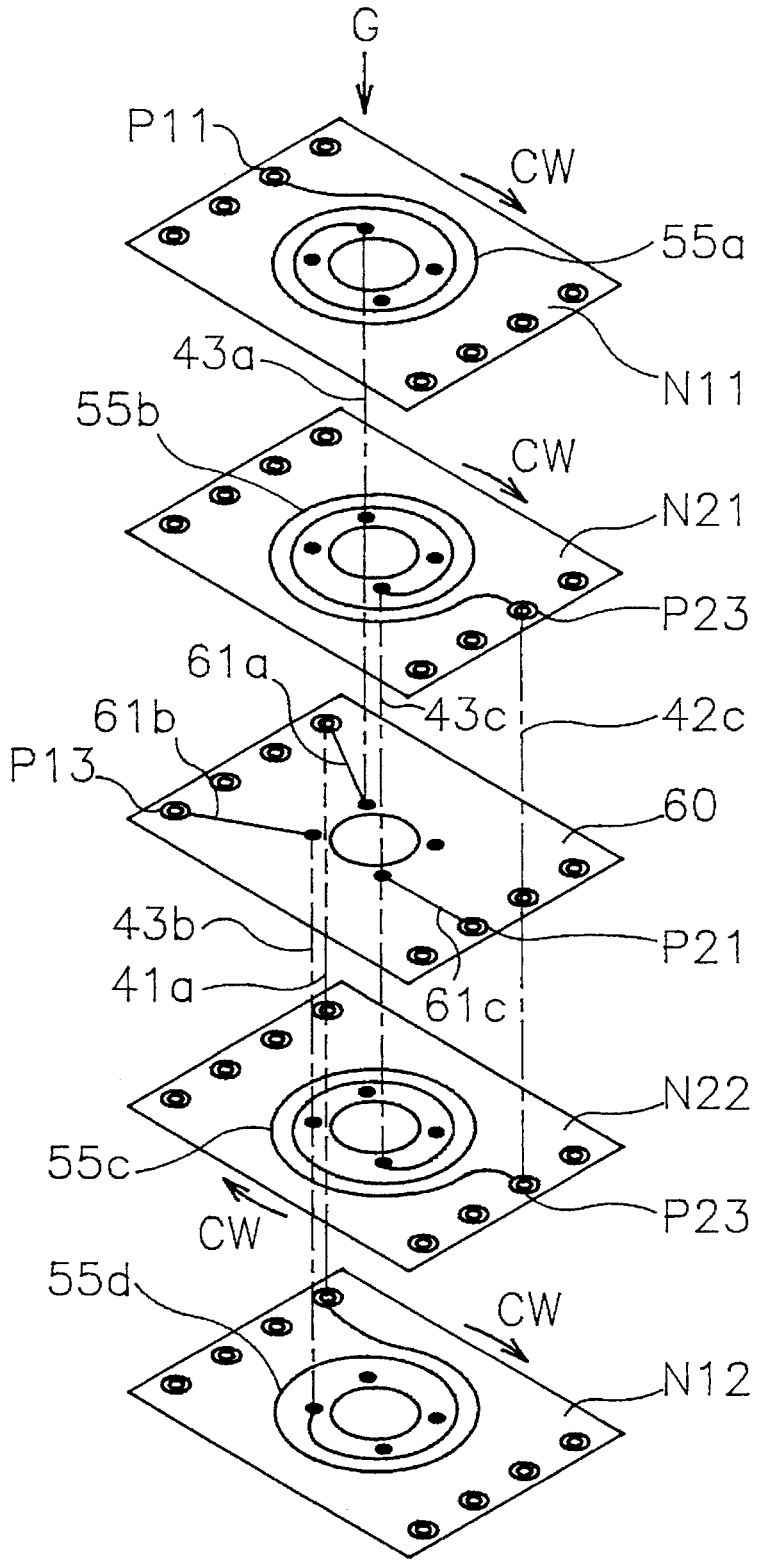
FIG. 12 is a view depicting the connections of the device of FIG. 7.

Connections to the device in FIG. 7 will now be discussed with reference to FIG. 12. In FIG. 12, five layers of printed coils are laminated together, in the order of 11th plane . . . 21st plane, connecting coil 60, 22nd plane, 12th plane, etc. A primary coil n1 of the transformer is structured by two planes of the 11th plane whose outside terminal is terminal P11, and the 12th plane having conductor pattern 55*d* connected to conductor pattern 55*a* on the 11th plane, in series. The inside terminal of conductor pattern 55*a* on the 11th plane and the inside terminal of connection pattern 61*a* on connecting coil 60 are connected by an inner peripheral terminal 43*a*, the outside terminal of connection pattern 61*a* on connecting pattern 55*d* on the 12th plane are connected by a primary terminal 41*a*, the inside terminal of conductor pattern 55*d* on the 12th plane and the inside terminal of connection pattern 61*d* on connecting coil 60 are connected by an inner peripheral terminal 43*b* and the outside terminal of connection pattern 61*d* on connecting coil 60 is used as terminal P13.

A secondary coil n2 is structured by two planes of the 21st plane on which the outside terminal of conductor pattern 55*c* is used as the terminal P23 and the 22nd plane on which the outside terminal of conductor pattern 55*c* is used as terminal P23. Conductor pattern 55*b* and conductor pattern 55*c* are connected to the inside terminal of connection pattern 61*c* on connecting coil 60 by an inner peripheral terminal 43*c*. Because the outside terminal of connection pattern 61*c* on connecting coil 60 is used as terminal P21, conductor pattern 55*b* and conductor pattern 55*c* are connected in parallel.

Figure 13:
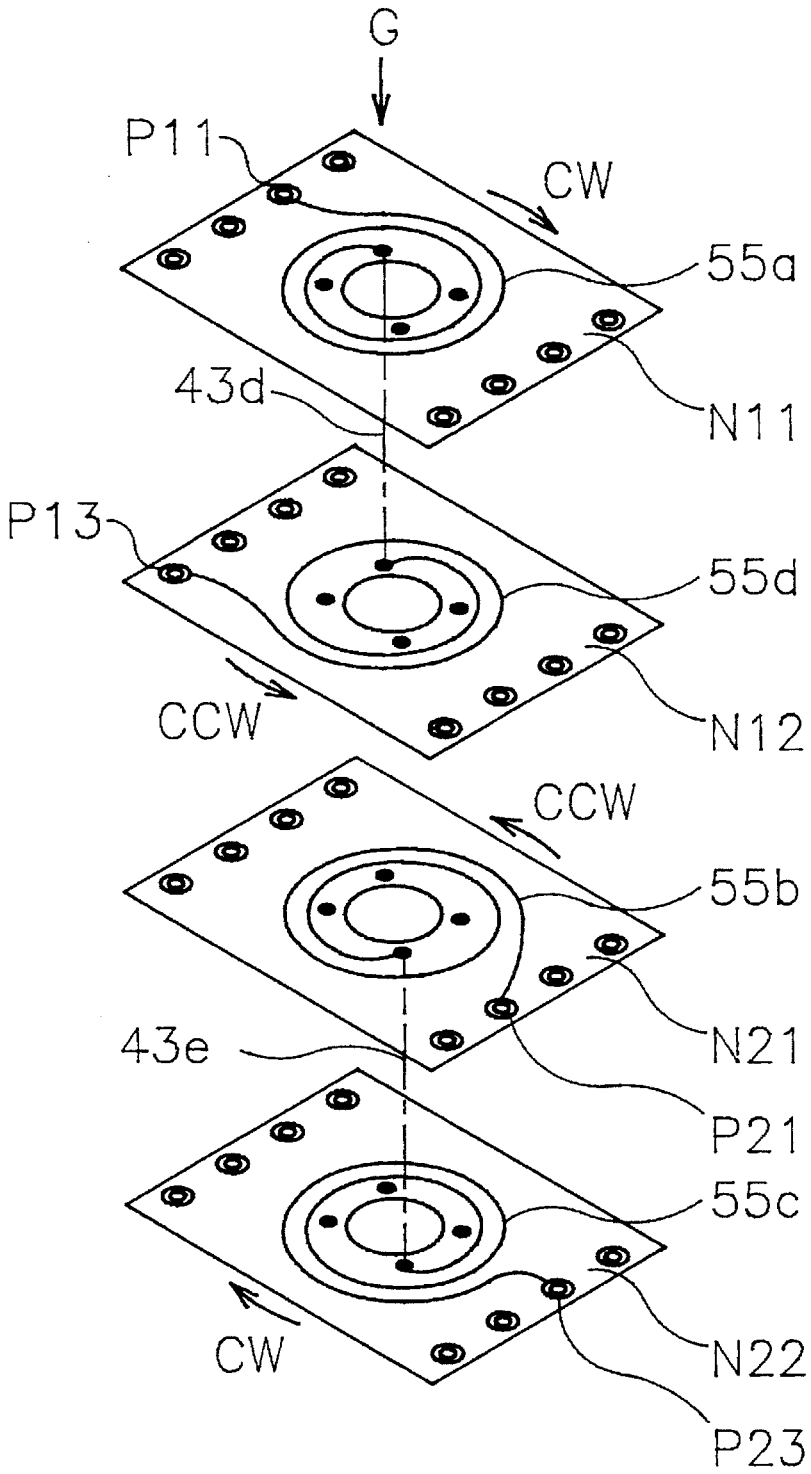
FIG. 13 is a view depicting a device for comparing with the embodiment of FIG. 12.

FIG. 13 shows a device for comparing with the embodiment of FIG. 12, wherein four layers of printed coils are laminated together in the order of 11th plane, 12th plane, 21st plane and 22nd plane, without using connecting coil 60. A primary coil n1 of the transformer is structured by the 11th plane, whose outside terminal is terminal P11, and the 12th plane, whose outside terminal is terminal P13. The inside terminals of conductor patterns 55*a* and 55*d* are connected by an inner peripheral terminal 43*d*. A secondary coil n2 is structured by two planes of the 21st plane, whose outside terminal is terminal P21, and the 22nd plane, whose outside terminal is terminal P23. The inside terminals of conductor patterns 55*b* and 55*c* are connected by an inner peripheral terminal 43*e*. Accordingly, conductor patterns 55*a* and 55*d* are connected in series as a primary winding n1 and conductor patterns 55*b* and 55*c* are connected in series as as secondary winding n2.

Referring now to FIGS. 12 and 13, the effects of the invention will now be explained. First, the enhancement of magnetic coupling will be explained. The more the planes of the primary coil and secondary coil directly contact each other, the better will be the magnetic coupling. In the structure of FIG. 13, the 12th and 21st planes are the subject of magnetic coupling. In contrast, in the embodiment of FIG. 12, the 11th and 21st planes, as well as the 12th and 22nd planes, are the subject of magnetic coupling. Because magnetic coupling is proportional to the square of the coil area, the magnetic coupling is increased by a factor of four.

Next, as to reduction of loss, AC resistance increases when a current flows in the same direction as a parallel conductor and the increase of AC resistance is suppressed when current flows in the opposite direction. This is called the "proximity effect". Because current flows in the same direction on the 11th and 12th planes, as well as in the 21st and 22nd planes in the structure of FIG. 13, the AC resistance thereof increases.

On the other hand, in the FIG. 12 embodiment, the direction of current flow is opposite on the 11th and 21st planes and on the 12th and 22nd planes. Thus, the AC resistance therein is suppressed. As a result, coil loss is reduced.

Next, floating capacity will be explained. The gaps between the 11th and 12th planes, and between the 12th and 21st planes and the 21st and 22nd planes, become capacitors and cause a floating capacity in the structure shown in FIG. 13. Normally, energy stored in a capacitor is proportional to the square of the voltage, and the larger the potential between neighboring layers, the greater the energy becomes. With a normal power source, a potential between the 11th and 12th planes is about 10 times that between the 21st and 22nd planes. Thus, energy stored in the floating capacity of the 11th and 12th planes is dominant. On the contrary, in the embodiment of FIG. 12, the gap between the 11th and 12th planes is separated and energy stored therebetween is reduced to about 1/10. As a result, the floating capacity is reduced, thereby improving the high frequency characteristics of the transformer.

Finally, the effect of coincident winding directions will be explained. Generally, the direction of increase of voltage coincides with the coil winding direction. Thus, because the potential between coil layers becomes greater when the winding direction of neighboring coils are opposite, rather than when they are in the same direction, and the energy stored in the floating capacity between the layers increases, the high frequency characteristic of the transformer may become degraded. In the structure of FIG. 13, the winding directions of the conductor patterns are opposite on the 11th and 12th planes as well as on the 21st and 22nd planes. That is, the patterns are wound clockwise on the 11th and 21st planes, and are wound counterclockwise on the 12th and 22nd planes. The term "counterclockwise" refers to that direction when the conductor pattern is observed from the direction of arrow G, with the shape of the spiral from the outside terminal Pij to the center being counterclockwise. The term "clockwise" refers to the direction when the conductor pattern is observed from the direction of arrow G, with the shape of the spiral from the outside terminal Pij to the center being clockwise.

In contrast, in the embodiment of FIG. 12, the winding direction of all of the conductor patterns is universally clockwise, except for the connecting coil 60. Thus, in the embodiment of FIG. 12, energy stored in the floating capacity between the layers is reduced, the floating capacity is reduced, and high frequency characteristics of the transformer is improved.

Figure 14:
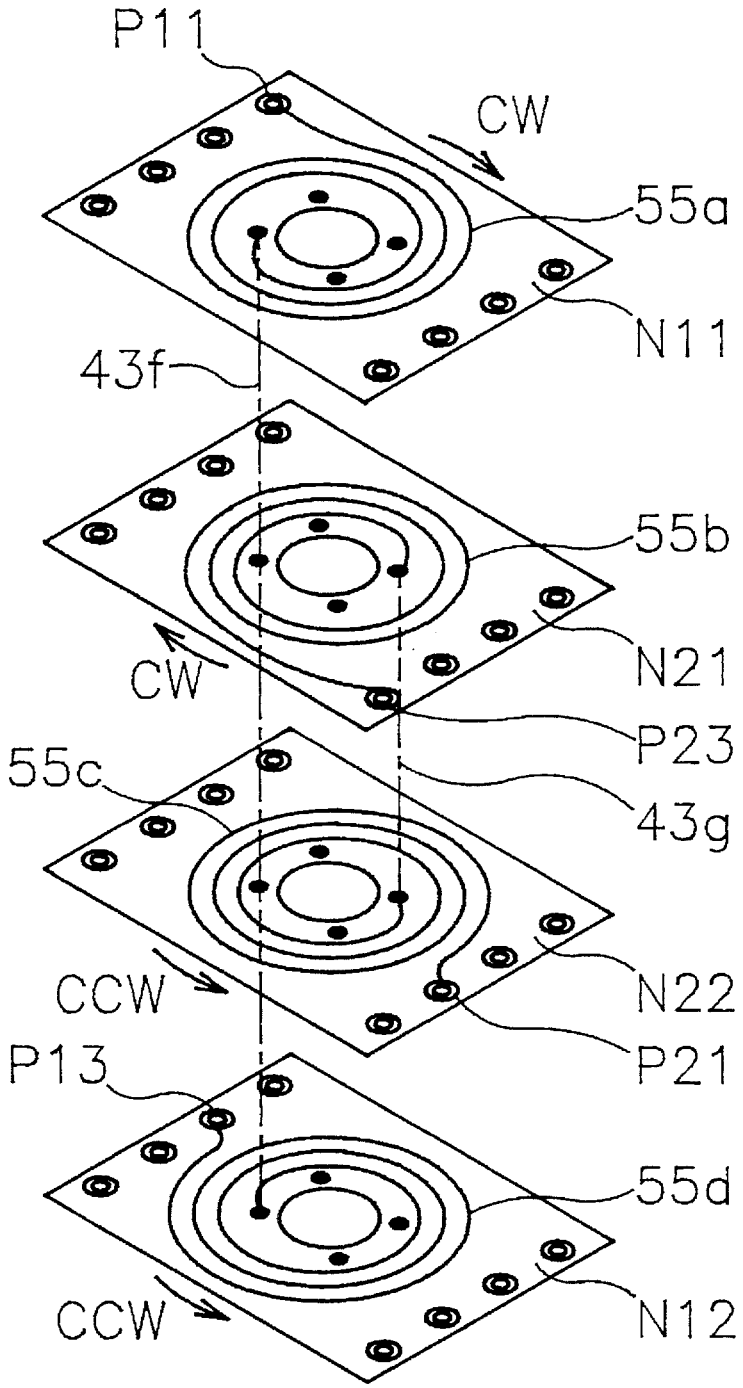
FIG. 14 is a perspective view depicting a second illustrative embodiment of the invention.

FIG. 14 shows the structure of the second illustrative embodiment, wherein the difference from the embodiment of FIG. 12 is that because no connecting coil is used, a number of conductor patterns 55 may be provided on conductor forming planes 54, even if the number of laminated printed coils is less. In FIG. 14, four layers of printed coils are laminated together in the order 11th plane, 21st plane, 22nd plane, and 21st plane. A primary coil n1 of the transformer comprises the 11th plane, whose outside terminal is terminal P11, and the 12th plane, whose outside terminal is terminal P13. Conductor pattern 55*a* on the 11th plane is connected with conductor pattern 55*b* on the 12th plane, in series, by an inner peripheral terminal 43*f*. A secondary coil n2 comprises two planes of the 21st plane, on which the outside terminal of conductor pattern 55*b* is used as terminal P21, and the 22nd plane, on which the outside terminal of the conductor pattern 55*c* is used as terminal P23. The conductor pattern 55*b* is connected to conductor pattern 55*c* in series by an inner peripheral terminal 43*g*. The winding direction of the conductor pattern is clockwise on the 11th and 21st planes and is counterclockwise on the 12th and 22nd planes.

When the printed coil of FIG. 14 is used in the circuit of FIG. 6, terminals P13 and P23 are connected to primary AC ground (AC GND) and secondary AC ground (AC GND), respectively. The AC grounds refer to a ground on an AC equivalent circuit and the terminals are connected to the ground or to an electrical conductor having a certain size and functioning as ground. Because the potential induced by the conductor pattern increases proportionally to the number of turns, AC potential increases from the outer periphery to the inner periphery between the 11th and 21st planes and AC potential increases from the outer periphery to the inner periphery between the 12th and 22nd planes. Accordingly, potential gradient in the radial direction becomes equal between the 11th and 21st planes and the 12th and 22nd planes, thereby enabling reduction of the floating capacity. Because floating capacity is a part of the floating capacity generated on the magnetic coupling plane of the primary and secondary windings described above, high frequency insulating characteristics of the transformer is improved.

Figure 15A:
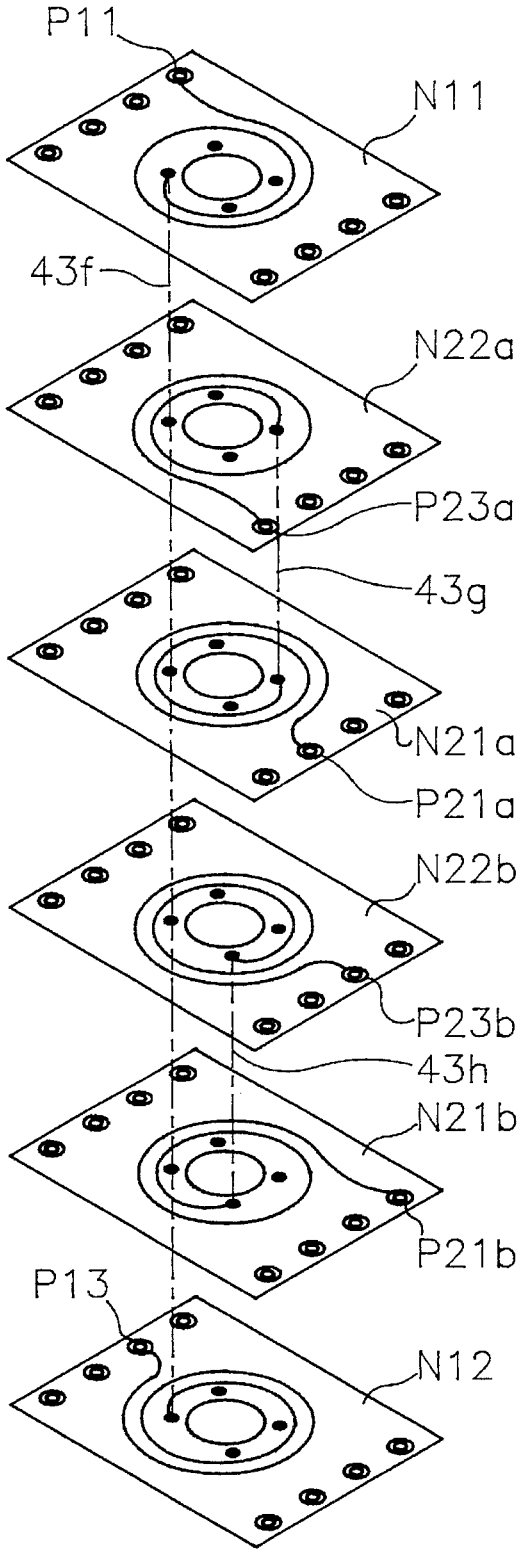
FIGS. 15A and 15B are perspective views depicting an embodiment having two secondary outputs.
Figure 15B:
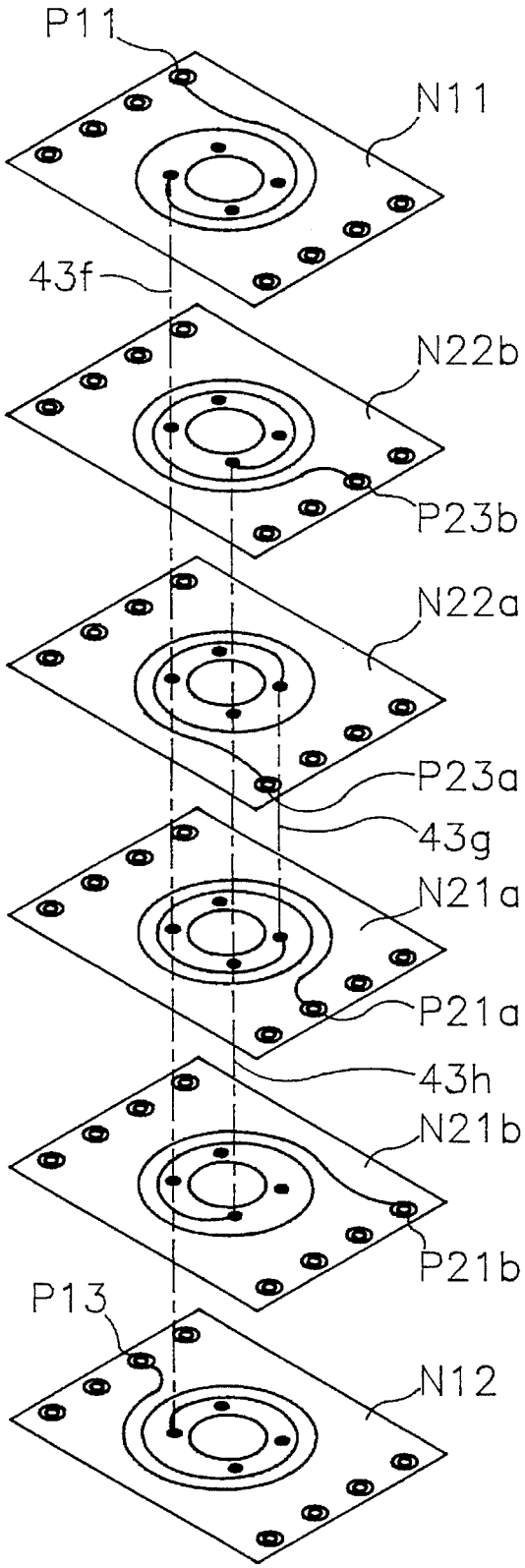

FIGS. 15A and 15B show an embodiment having two secondary outputs, wherein FIG. 15A shows a parallel configuration of the secondary windings, and FIG. 15B shows the windings arranged telescopically. In FIGS. 15A and 15B, each conductor pattern forming plane N2kx of the secondary winding is represented by outside terminals P21*x* of the conductor pattern, wherein "x" represents the output number of the secondary winding, which is "a" or "b" in this case; "k" represents the connection relationship of the terminals, wherein k=1 when the terminal is located on the AC ground side and k=2 when the terminal is located on the potential generating side; and "l" represents the connection relationship of the outside terminals, wherein l=1 when k=1, and l=3 when k=2.

In FIG. 15A, conductor forming planes N22*a* and N21*a* of the first output of the secondary winding are laminated together adjoining each other and are connected by inner peripheral terminal 43*g*. Conductor forming planes N22*b* and N21*b* of the second output of the secondary winding are laminated together adjoining each other and are connected by inner peripheral terminal 43*h*. The conductor forming planes N22*a* through N21*b* of the secondary winding are disposed between conductor forming planes N11 and N12 of the primary winding. With this arrangement, leakage inductance is reduced, increase of resistance due to the proximity effect, is reduced or suppressed, and floating capacity is less, when compared to the prior art in terms of the relationship of the magnetic coupling plane of the primary and secondary windings.

In FIG. 15B, the conductor forming planes N22*b* and N22*a*, having terminals on the potential generating side of the secondary winding, are laminated together adjoining each other. The conductor forming planes N21*a* and N21*b*, having the AC ground terminal of the secondary winding, are laminated together adjoining each other. The conductor forming planes N22*b* through N21*b* of the secondary winding are disposed between conductor forming planes N11 and N12 of the primary winding. Accordingly, because the upper three layers and the lower three layers are arranged to have their windings in directions which are counterclockwise and clockwise respectively, floating capacity is less than for the embodiment of FIG. 15A.

Figure 16A:
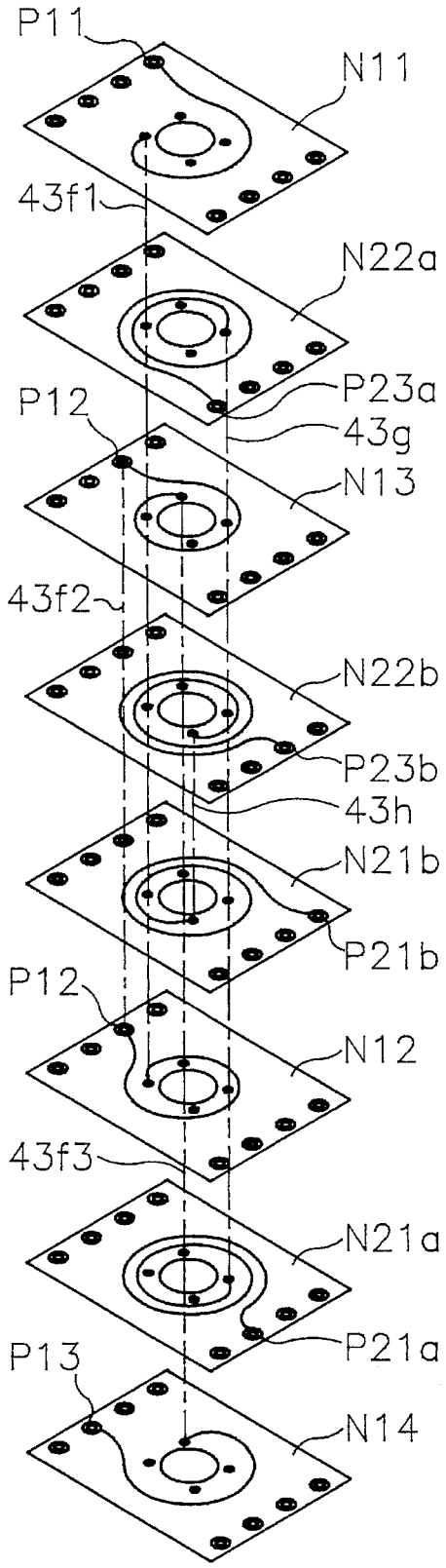
FIGS. 16A and 16B are perspective views depicting a plurality of primary coils.
Figure 16B:
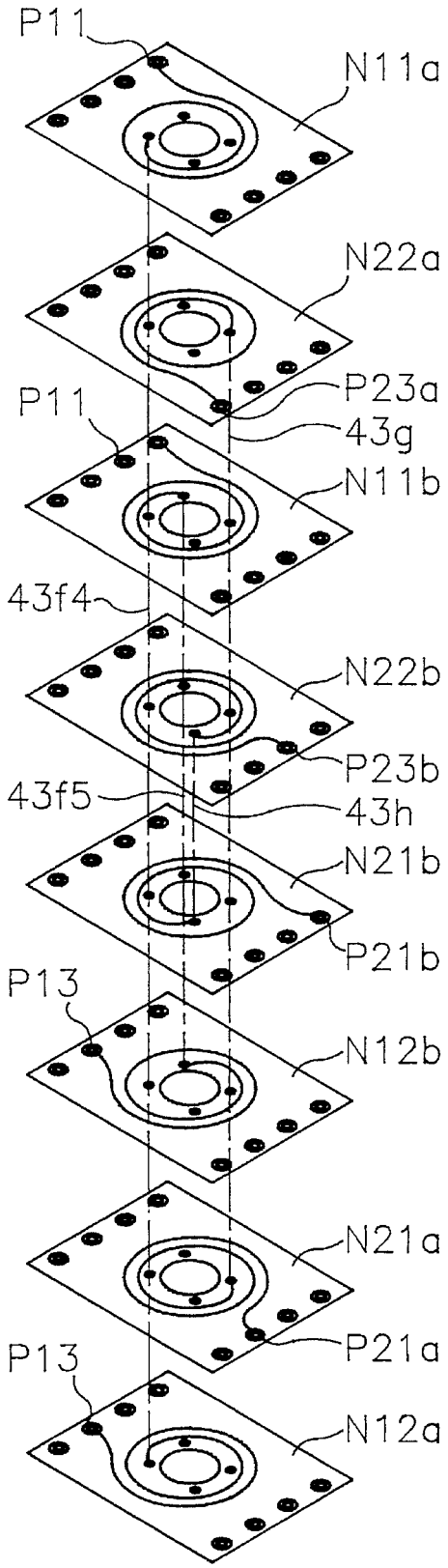

FIGS. 16A and 16B show a plurality of coils, wherein FIG. 16A shows four planes connected in series to widen the width of the conductor pattern on each plane, and FIG. 16B shows sets of two planes connected in parallel. In FIG. 16A, eight layers of conductor forming planes N11, N22*a*, N13, N22*b*, N21*b*, N12, N21*a*, and N14 are assembled and the upper four layers and lower four layers are arranged to have their winding directions to be counterclockwise and clockwise, respectively. As the primary winding, they are laminated in the order N11, N13, N12, and N14. Conductor forming planes N11 and N12 are connected by an inner peripheral terminal 43f1, conductor forming planes N12 and N13 are connected by an inner peripheral terminal 43f2 and conductor forming planes N13 and N14 are connected by an inner peripheral terminal 43f2. Thus, the conductor forming planes are connected in series in the order N11, N12, N13, and N14. An AC voltage generated on the primary winding is highest on the conductor forming plane N14 and lowest on the conductor forming plane N11.

Conductor forming planes N22*a* and N21*a*, of the first output of the secondary winding, are laminated together while being separated as the second layer and the seventh layer from the top, and are connected by inner peripheral terminal 43*g*. Conductor forming planes N22*b* and N21*b*, of the second output of the secondary winding, are laminated together adjoining each other and are connected by inner peripheral terminal 43*h*. Current capacity is increased by reducing the number of windings per conductor forming plane by a factor of one half and by doubling the width of the conductor pattern as compared with FIG. 15B. Conductor forming planes N22*b* and N21*b*, which are the second output circuit of the secondary winding, are disposed between conductor forming planes N12 and N13 which are the middle primary winding. The middle primary winding is itself disposed between conductor forming planes N22*a* and N21*a* which are the first output circuit of the secondary winding. The outermost layers are covered by the conductor forming planes N11 and N14 of the primary winding which are connected to the outside.

In FIG. 16B, the first input circuits of the conductor forming planes N11*a* and N12*a*, which are primary windings, are laminated together while being separated as the first and eighth layers from the top and are connected by an inner peripheral terminal 43f4. The second input circuits of the conductor forming planes N11*b* and N12*b* are laminated together adjoining each other as the fourth and fifth layers and are connected by an inner peripheral terminal 43f5. The first and second input circuits are connected in parallel by terminals P11 and P13. Conductor forming planes N22*a* and N21*a* of the first output circuit of the secondary winding are laminated together while being separated as the second and seventh layers from the top and are connected by inner peripheral terminal 43*g*. Conductor forming planes N22*b* and N21*b*, of the second output circuit of the secondary winding, are laminated together adjoining each other and are connected by inner peripheral terminal 43*h*. This configuration allows increase of the current capacity, even when the number of windings of the conductor pattern for the primary winding and the width of the conductor pattern are the same as those in FIG. 15.

As described above, according to the invention, secondary coil 20 is held between the primary coil 10, and the primary winding and secondary winding of a transformer are formed by connecting the interlayer link lines provided at the middle of the conductor forming planes, so that leakage inductance is reduced, increase of resistance due to the proximity effect is reduced or suppressed, and floating capacity is less, as compared to the prior art from the perspective of magnetic coupling planes of the primary and secondary windings.

Figure 17:
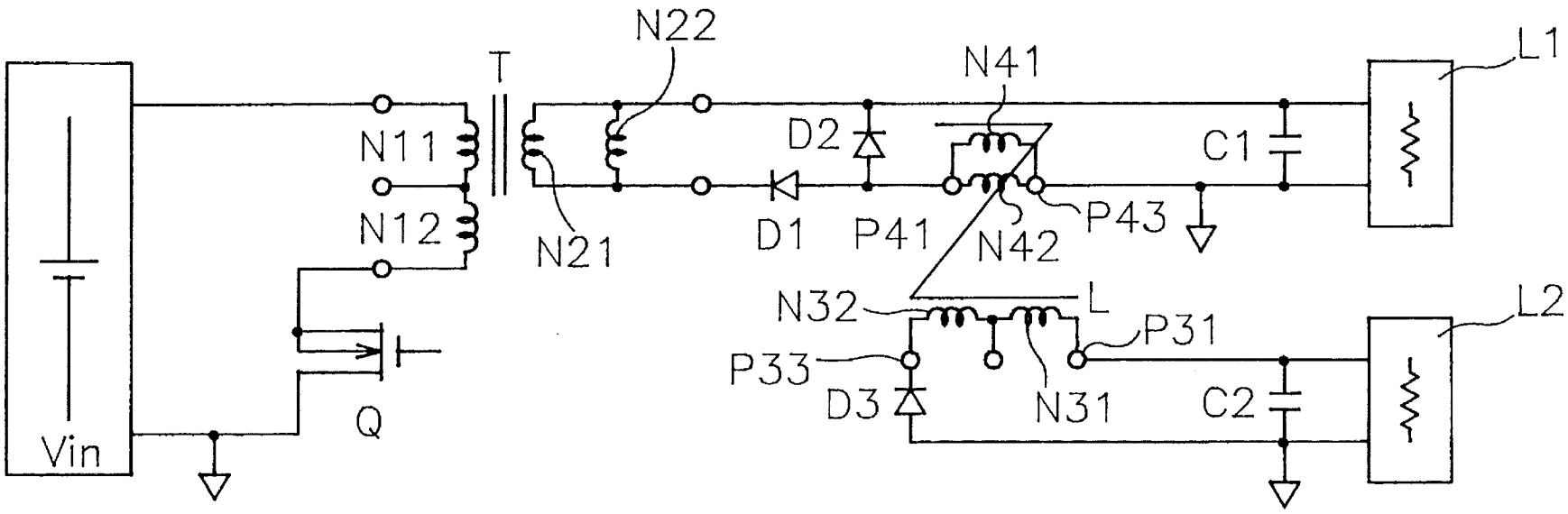
FIG. 17 is a circuit diagram depicting an embodiment of the invention as used in a choking coil.

FIG. 17 shows the invention as used in a choking coil, wherein similar to FIG. 6, DC power source Vin is applied to the primary winding and switching element Q turns ON and OFF the circuit. A switching signal is induced on the secondary winding and is sent to an output circuit comprising diodes D1 and D2, main winding of a choking coil L and capacitor C1, and a rectified and smoothed DC voltage is supplied to a main load L1. A rectifying and smoothing circuit, comprising a diode D3 and capacitor C2, is connected to an auxiliary winding side of the choking coil L to supply DC power to an auxiliary load L2.

In this embodiment, primary coils N31 and N32 are connected in series on the auxiliary winding side of the choking coil L and secondary coils N41 and N42 are connected in parallel on the main winding side. Furthermore, a terminal P31 is connected to one end of capacitor C2 and a terminal P33 is connected to capacitor C2 via diode D3. Terminals P41 and P43 are connected to diodes D1 and capacitor C1.

Figure 18:
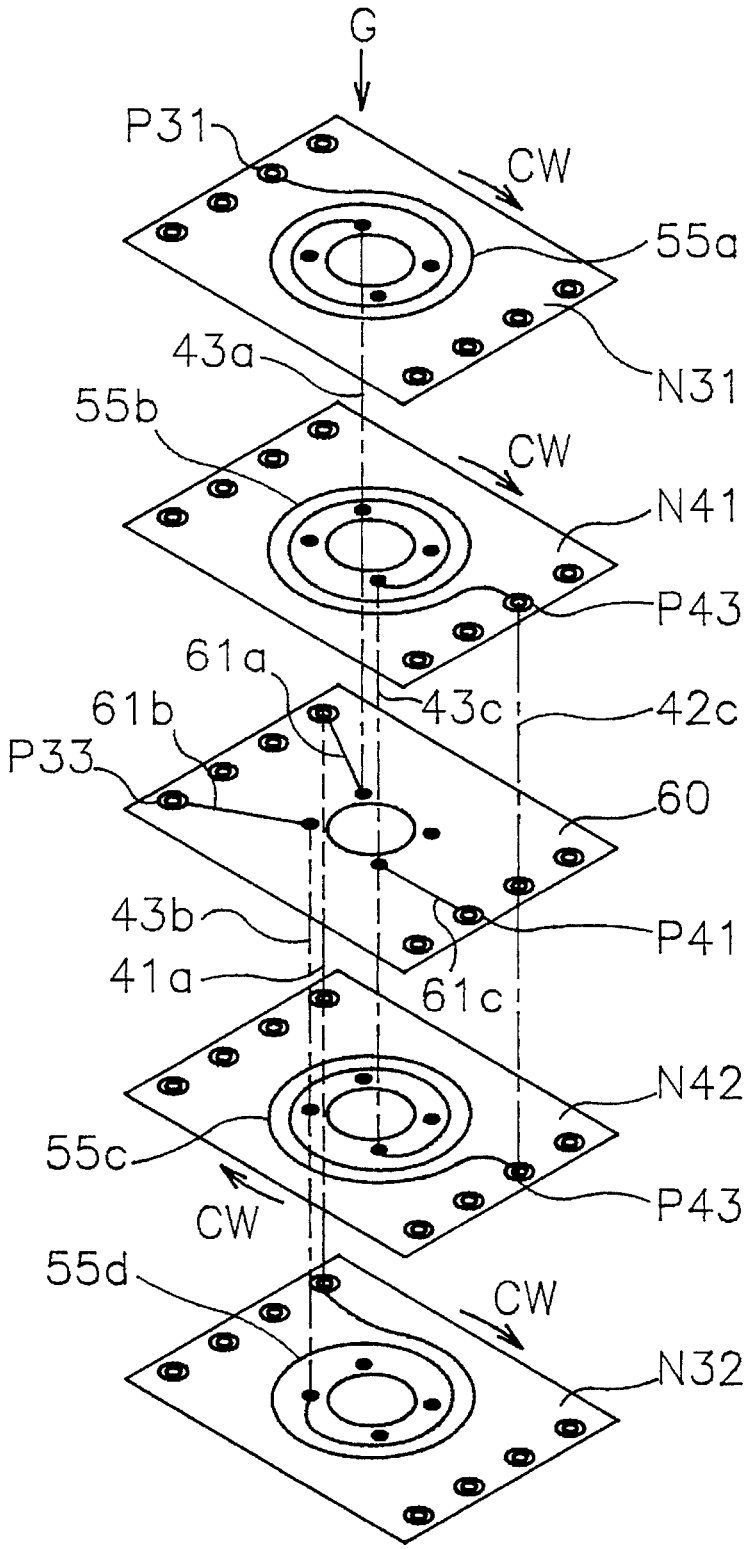
FIG. 18 is a perspective view depicting the connections of the choking coil of FIG. 17.

The connection of the choking coil will now be explained with reference to FIG. 18. Although lamination of the printed coils in FIG. 18 is substantially the same as that shown in FIG. 12, the reference numerals of the conductor forming planes and terminals are matched with those in FIG. 17 in order to conform to FIG. 17. Five layers of printed coils are laminated in the order 31st plane, 41st plane, connecting coil 60, 42nd plane and 32nd plane.

The auxiliary winding of the choking coil L is formed by two planes of the 31st plane, whose outside terminal is terminal P31, and the 32nd plane, having conductor 55*d* connected to conductor 55*a* on the 31st plane, in series. The inside terminal of conductor pattern 55*a* on the 31st plane and the inside terminal of connection pattern 61*a* on connecting coil 60 are connected by an inner peripheral terminal 43*a*. The outside terminal of connection pattern 61*a* on connecting coil 60 and the outside terminal of conductor patter 55*d* on the 32nd plane are connected by a primary terminal 41*a*. The inside terminal of conductor pattern 55*d* on the 32nd plane and the inside terminal of the connection patter 61*d* on the connecting coil 60 are connected by an inner peripheral terminal 43*b*. The outside terminal of connection pattern 61*d* on connecting coil 60 is used as terminal P33.

The main winding of choking coil L is formed by two planes of primary terminal 41st plane on which the outside terminal of conductor pattern 55*c* is used as terminal P43 and the secondary terminal 42nd plane on which the outside terminal of conductor pattern 55*c* is used as the terminal P43. Conductor pattern 55*b* and conductor pattern 55*c* are connected to the inside terminal of connection pattern 61*c* on connecting coil 60 by an inner peripheral terminal 43*c*. Because the outside terminal of connection pattern 61*c* on connecting coil 60 is used as terminal P41, conductor pattern 55*b* and conductor pattern 55*c* are connected in parallel.

Figure 19:
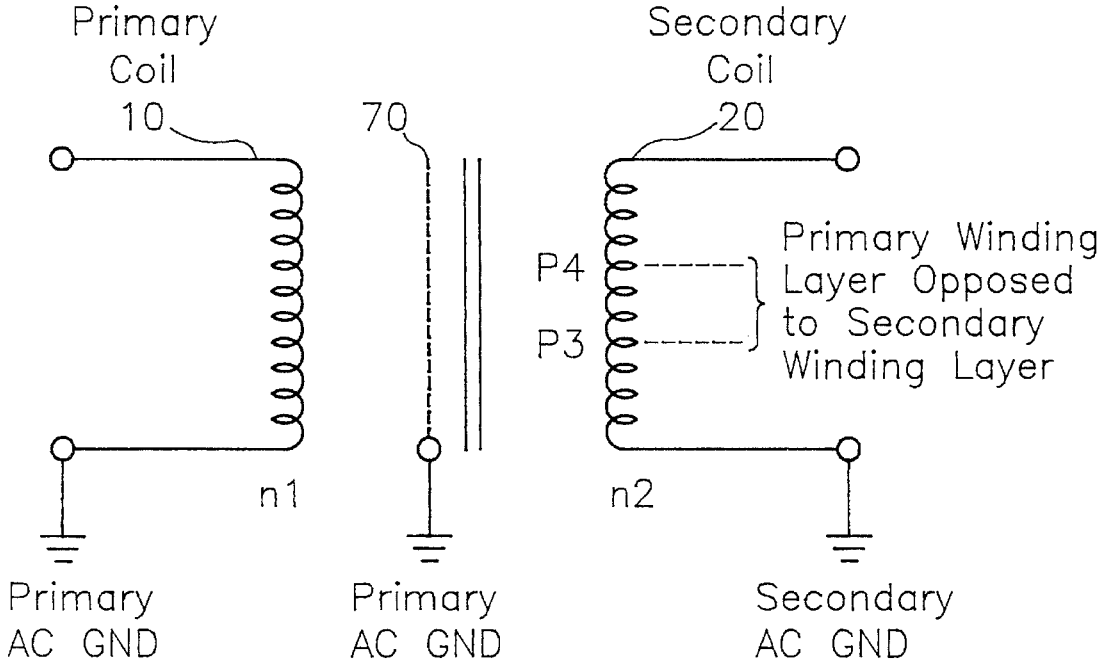
FIG. 19 is a circuit diagram depicting a transformer having a shield.

Turning now to FIG. 19, a third illustrative embodiment is shown as a transformer. Some transformers have a shield, such as shown in Japan UM Laid-Open No. 62/201,915. FIG. 19 is a circuit diagram of such type of transformer, wherein AC current is applied to one end of the anode of a primary winding n1 of the transformer and the other end thereof is grounded to a primary ground AC GND. One end of secondary winding n2 is grounded to a secondary ground AC GND and AC current is induced on the other end thereof. A ground shield winding 70 is disposed between the primary winding n1 and the secondary winding n2 and one end thereof is grounded to primary AC GND.

Figure 20:
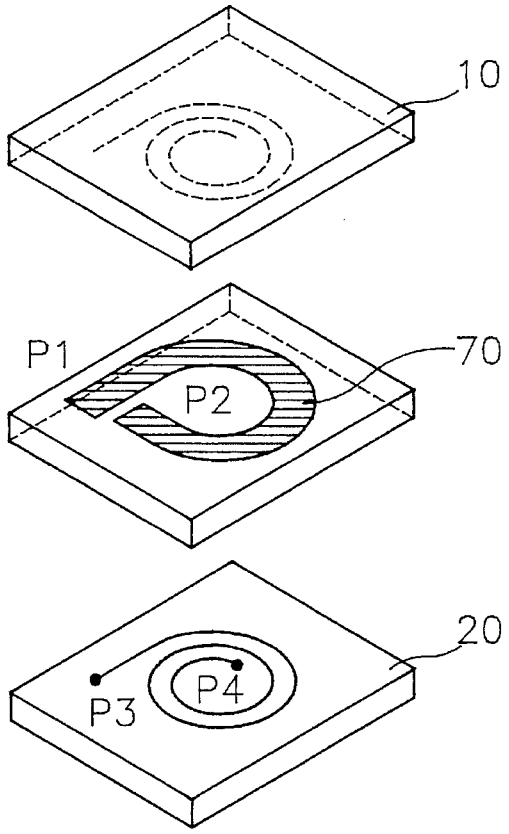
FIG. 20 is a perspective view depicting the main parts of the structure of a printed coil type transformer having the circuit of FIG. 19.

FIG. 20 shows the structure of a printed circuit type transformer such as shown in FIG. 19. A conductor pattern, equivalent to primary winding n1, is formed on the base of primary coil 10. A secondary coil 20, which is a conductor pattern equivalent to the secondary winding n2, is formed on the base thereof, wherein several turns of a spiral conductor pattern extends from a starting terminal P3 to an ending terminal P4 formed on a plane. Shield coil 70 is inserted between the bases of primary coil 10 and secondary coil 20, wherein the coils are arranged to be opposite of each other. Shield coil 70 has one turn of a spiral wide conductor pattern extending from starting terminal P1 to an ending terminal P2 formed on one plane.

Figure 21:
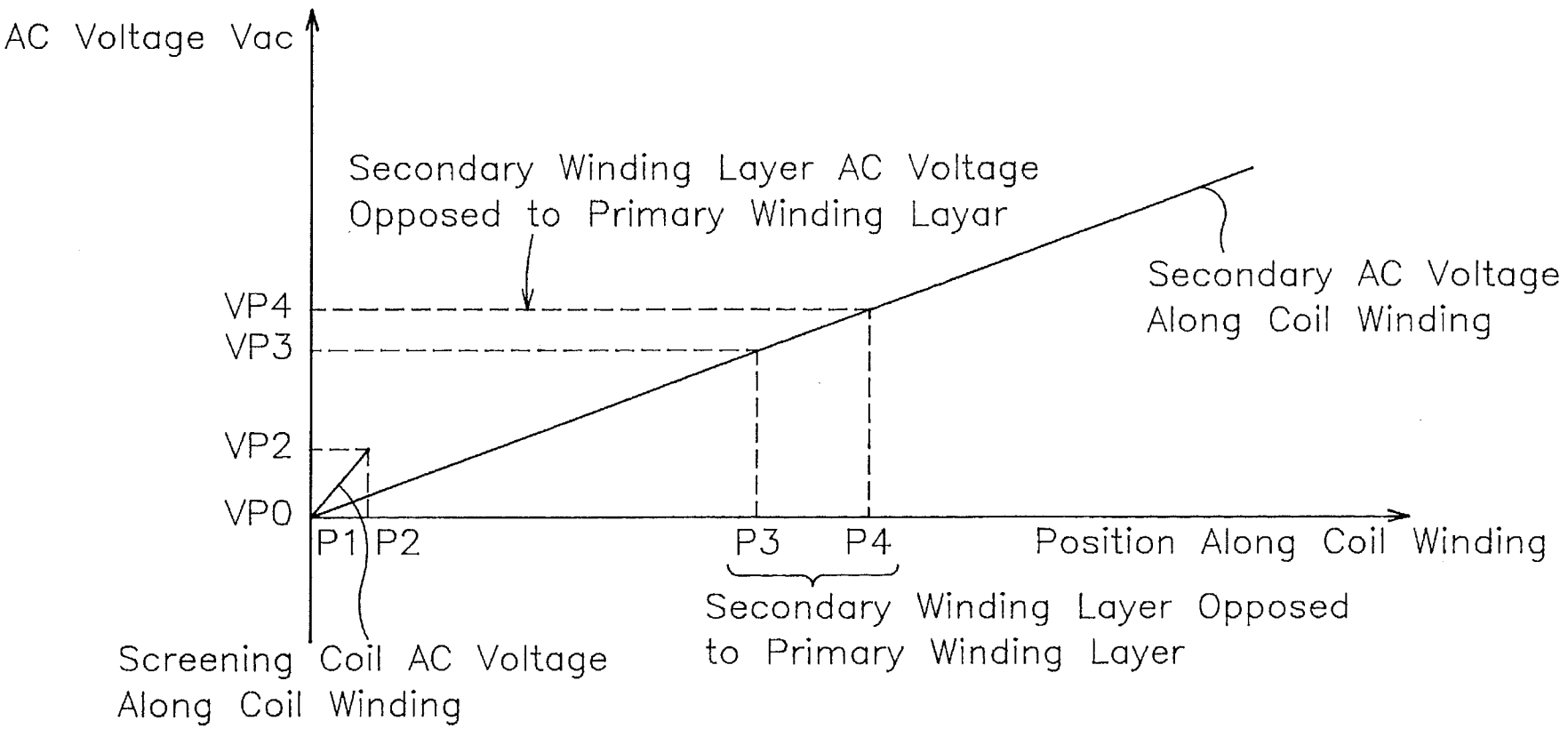
FIG. 21 is a graph depicting the relationship between the number of windings of each winding and the AC voltage.

FIG. 21 shows the relationship between the number of turns of windings of each winding and the AC voltage. AC voltage Vac, induced corresponding to the position along the coil winding, increases on secondary coil 20. Assuming that the voltage of the secondary winding layer opposed to the primary winding layer is Vp3 at the starting terminal P3, and is Vp4 at the ending terminal P4, then, the voltage of the secondary winding layer opposed to he primary winding layer is between Vp3 and Vp4. The winding layer opposed to the primary winding layer is the shield coil 70, or a layer on which the conductor pattern opposed to the one is formed. By the same token, because the winding layer is formed only on one plane in shield coil 70, the shield voltage thereof is in the range of Vp1 to Vp2.

In the above circuit, even though various advantages exist, noise current flow would degrade the characteristics of a transformer when the potential difference between the AC voltage of the secondary winding layer, opposed to the primary winding layer (Vp3 to Vp4) and the voltage of the shield coil (Vp1 to Vp2) is large. Thus, a separate noise filtering circuit, having good noise reducing characteristics, is needed, when the transformer is used, for example, in a switching power source. The third illustrative embodiment solves this problem and provides a printed coil type transformer having good shielding characteristics.

Figure 22:
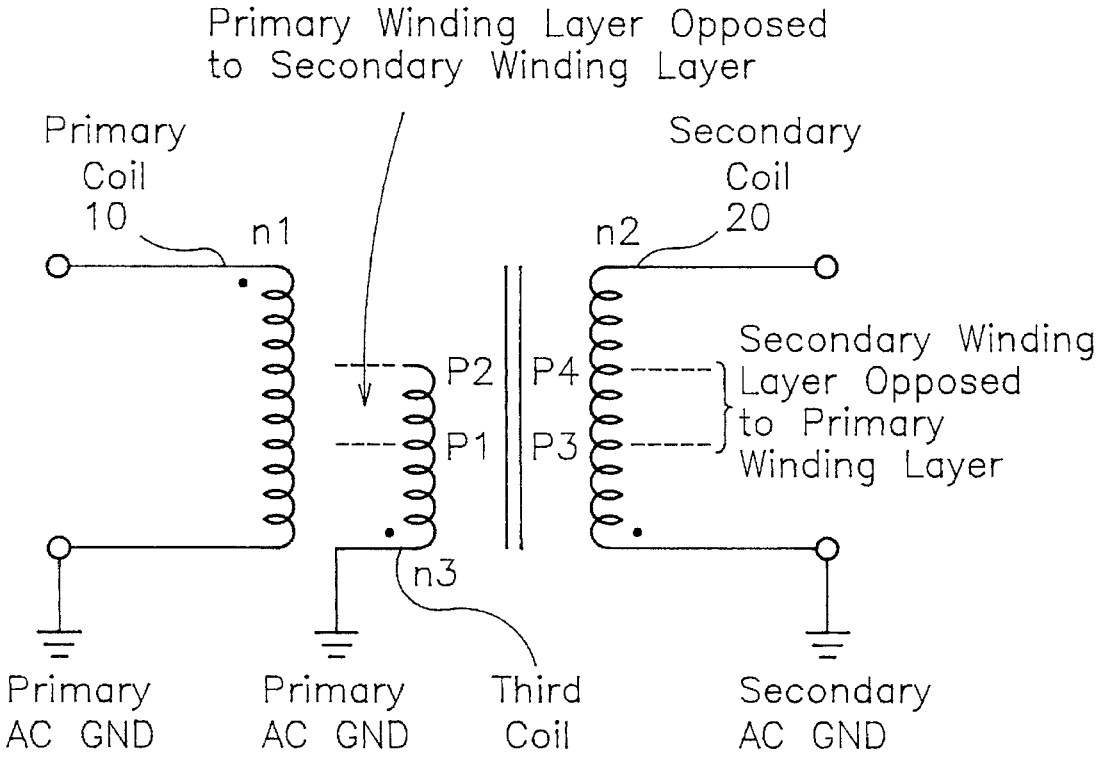
FIG. 22 is a circuit diagram depicting a third illustrative embodiment of the invention.

FIG. 22 shows the third illustrative embodiment, wherein primary winding n1 is a conductor pattern wound so that a polarity of the transformer becomes opposite from that of secondary winding n2. A third winding n3 is grounded to AC GND common with the AC GND of the primary winding, and its conductor pattern is formed so that its polarity coincides with that of the secondary winding.

Figure 23:
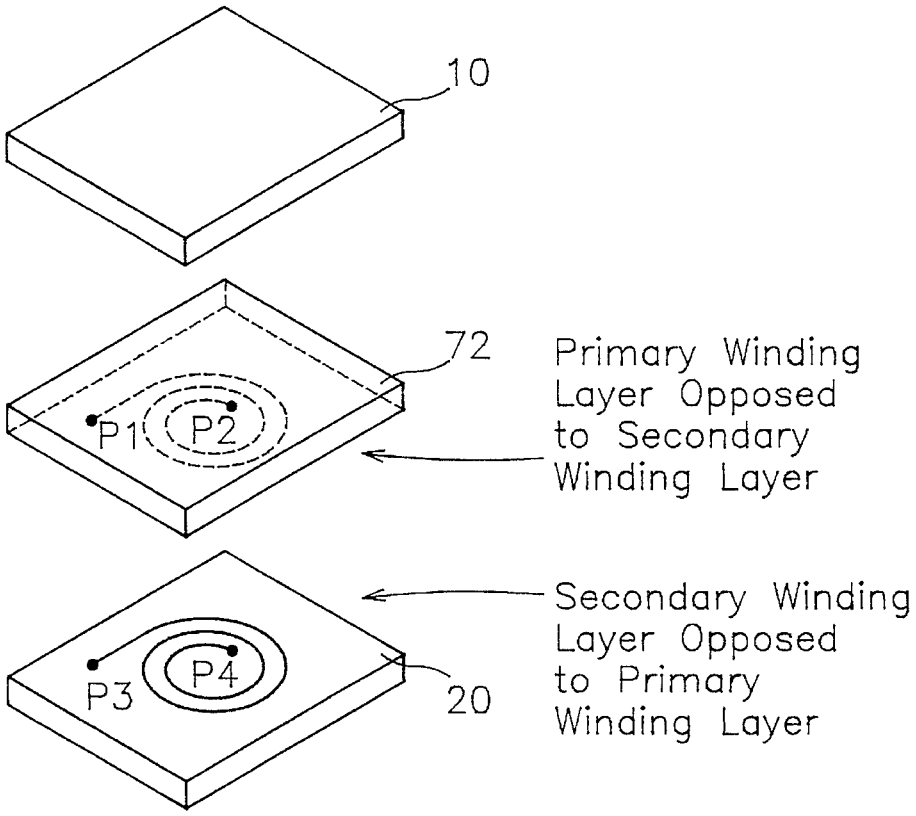
FIG. 23 is a perspective view depicting the main part of the structure of the device of FIG. 22.

FIG. 23 shows the structure of the device of FIG. 22, wherein secondary coil 20 is the conductor pattern which is equivalent to the secondary winding n2, is formed on the base thereof with several turns of a sprial conductor pattern extending from starting terminal P3 to ending terminal P4 formed on one plane of the conductor winding layer closest to the primary coil 10. A third coil 72 is inserted between the bases of primary coil 10 and secondary coil 20 where they oppose each other, and a spiral conductor pattern extending from starting terminal P1 to ending terminal P2 is formed on a plane opposed to the secondary coil 20. Primary coil 10 is mounted on the third coil 72.

Figure 24:
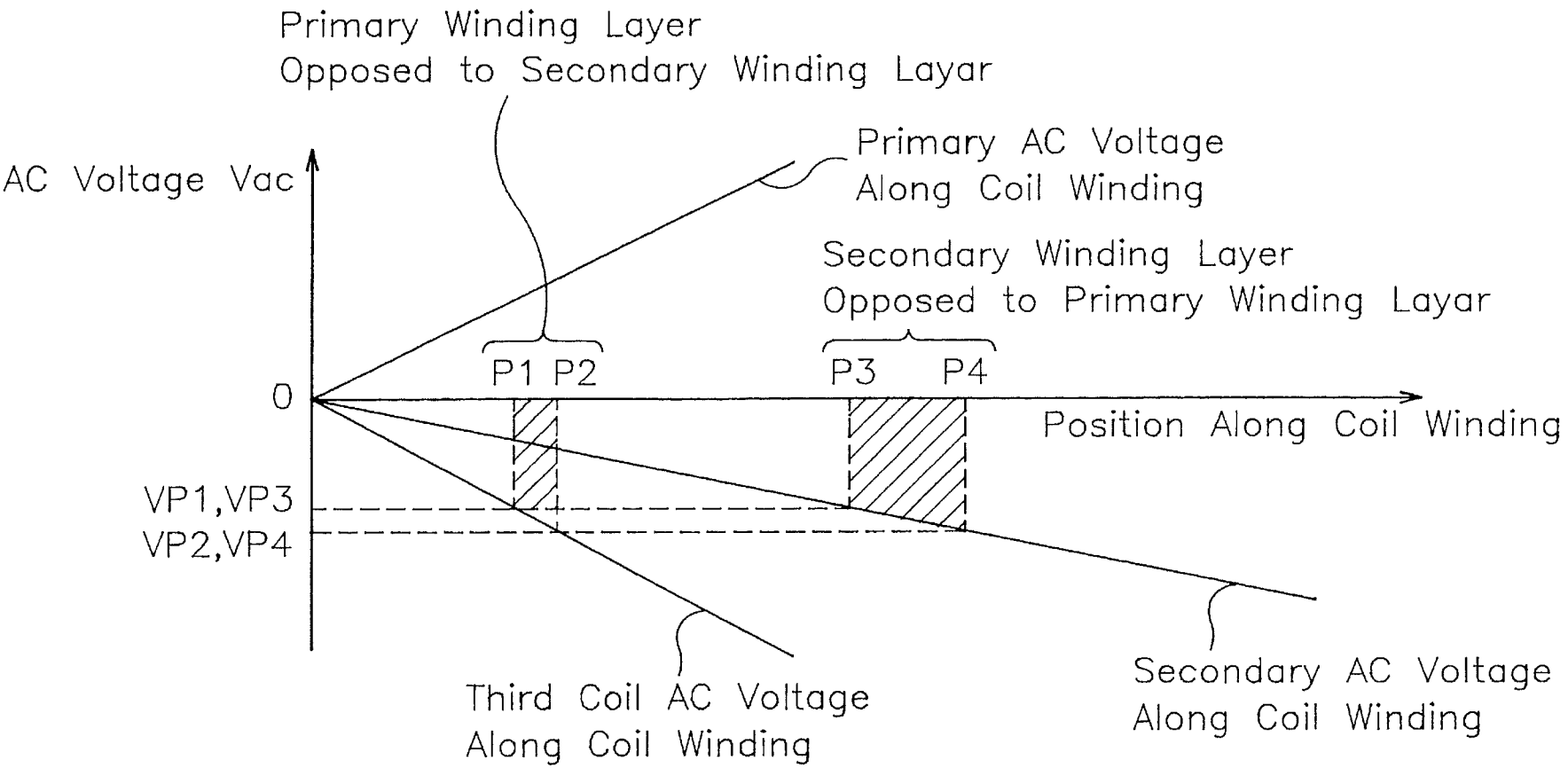
FIG. 24 is a graph depicting the relationship between the number of windings of each winding and the AC voltage for the circuit of FIG. 22.

FIG. 24 shows the relationship between the number of windings of each winding and the AC voltage. AC voltage Vac, induced corresponding to positions along the coil winding, increases on secondary coil 20. Assuming that a voltage of secondary winding layer opposed to third coil 72, is Vp3 at the starting terminal P3 and is Vp4 at the ending terminal P4, then, the voltage of the secondary winding layer opposed to the primary winding layer is in the range of Vp3 to Vp4. For third coil 72, the voltage of the primary winding layer opposed to the secondary winding layer (Vp1 to Vp2) is predetermined to coincide with the voltage of the secondary winding layer opposed to the primary winding coil (Vp3 to Vp4). On the other hand, because the winding direction of primary coil 10 is opposite, the generated AC voltage is an opposite voltage from that of the secondary coil 20 and no region which coincides with the secondary winding layer opposed to the primary winding layer Vp3 to Vp4, exists.

Next will be explained the reason for forming the conductor pattern so that the voltage of the primary winding layer opposed to the secondary winding layer (Vp1 to Vp2) coincides with the secondary winding layer opposed to the primary winding layer (Vp3 to Vp4). Assuming that the shape of the conductor pattern has a mirror image of that formed on the layer opposed to the primary winding layer of the secondary coil 20, then, the voltages induced by the AC current applied to the primary winding coincide. This is not completely favorable because the separation becomes considerably small in the distribution in the radial direction even when the directions of the spirals are opposite. Furthermore, because almost no current flows in the third coil 72, the pattern width of the conductor patterns, other than that of the primary winding layer opposed to the secondary winding layer, may be narrowed and one layer will suffice.

Figure 25:
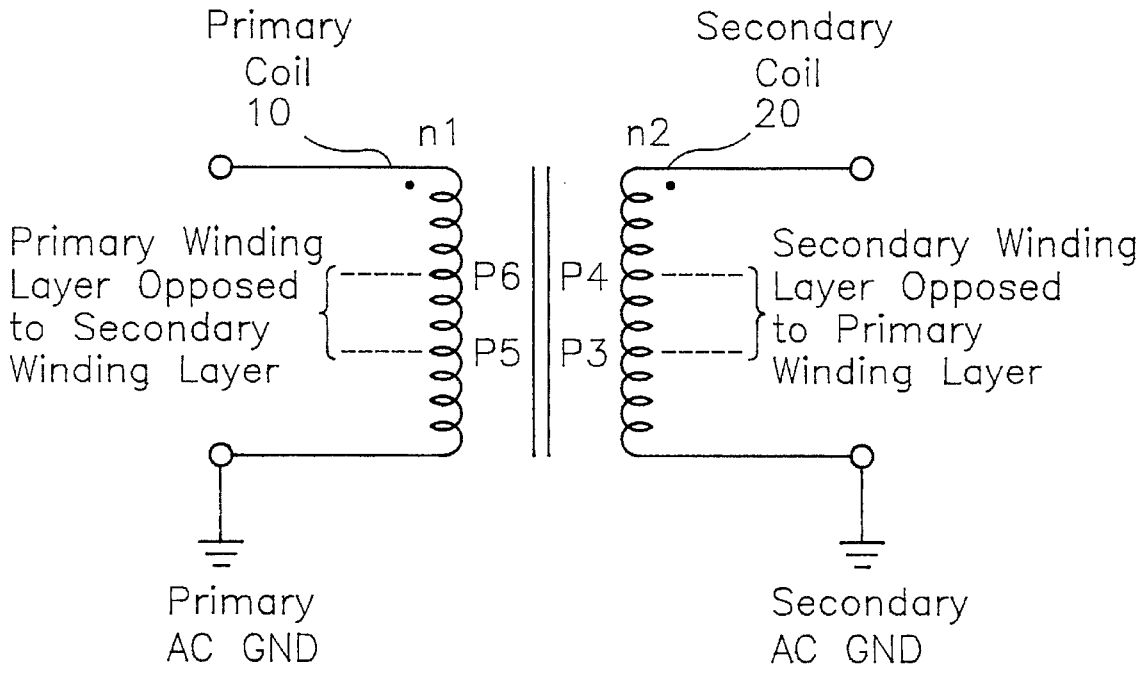
FIG. 25 is a circuit diagram depicting another aspect of the third illustrative embodiment.

FIG. 25 shows another embodiment wherein the difference from FIG. 22 is that the primary winding n1 is a conductor pattern wound so that the transformer polarity coincides with that of the secondary winding n2.

Figure 26:
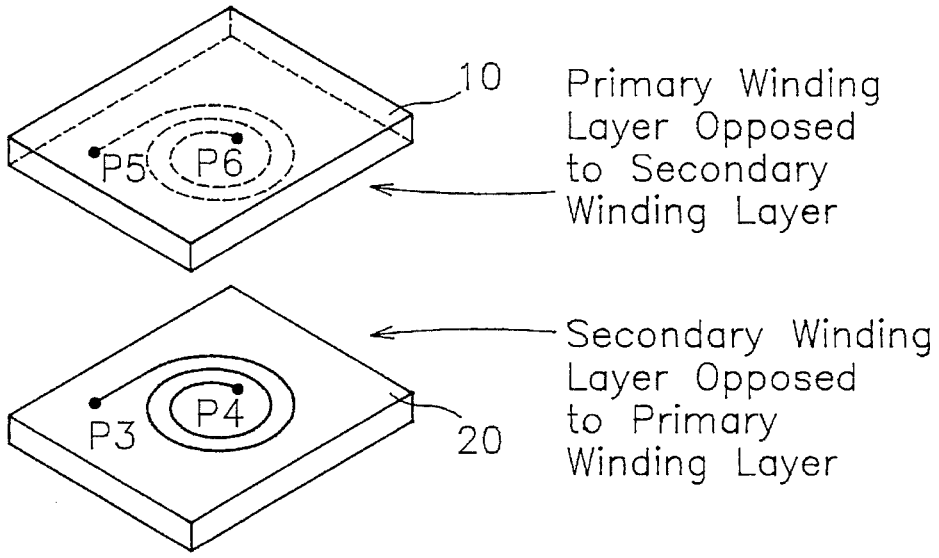
FIG. 26 is a perspective view depicting the main part of the structure of the device of FIG. 25.

FIG. 26 shows the structure of the device of FIG. 25, wherein secondary coil 20 is a conductor pattern, which is equivalent to the secondary winding n2 formed on the base thereof, with several turns of a spiral shaped conductor pattern extending from starting terminal P3 to ending terminal P4, formed on one plane. Primary coil 10 is a conductor pattern, which is equivalent to primary winding n1, formed on the base thereof, with several turns of a spiral shaped conductor pattern extending from starting terminal P5 to ending terminal P6 formed on one plane opposed to secondary coil 20.

Figure 27:
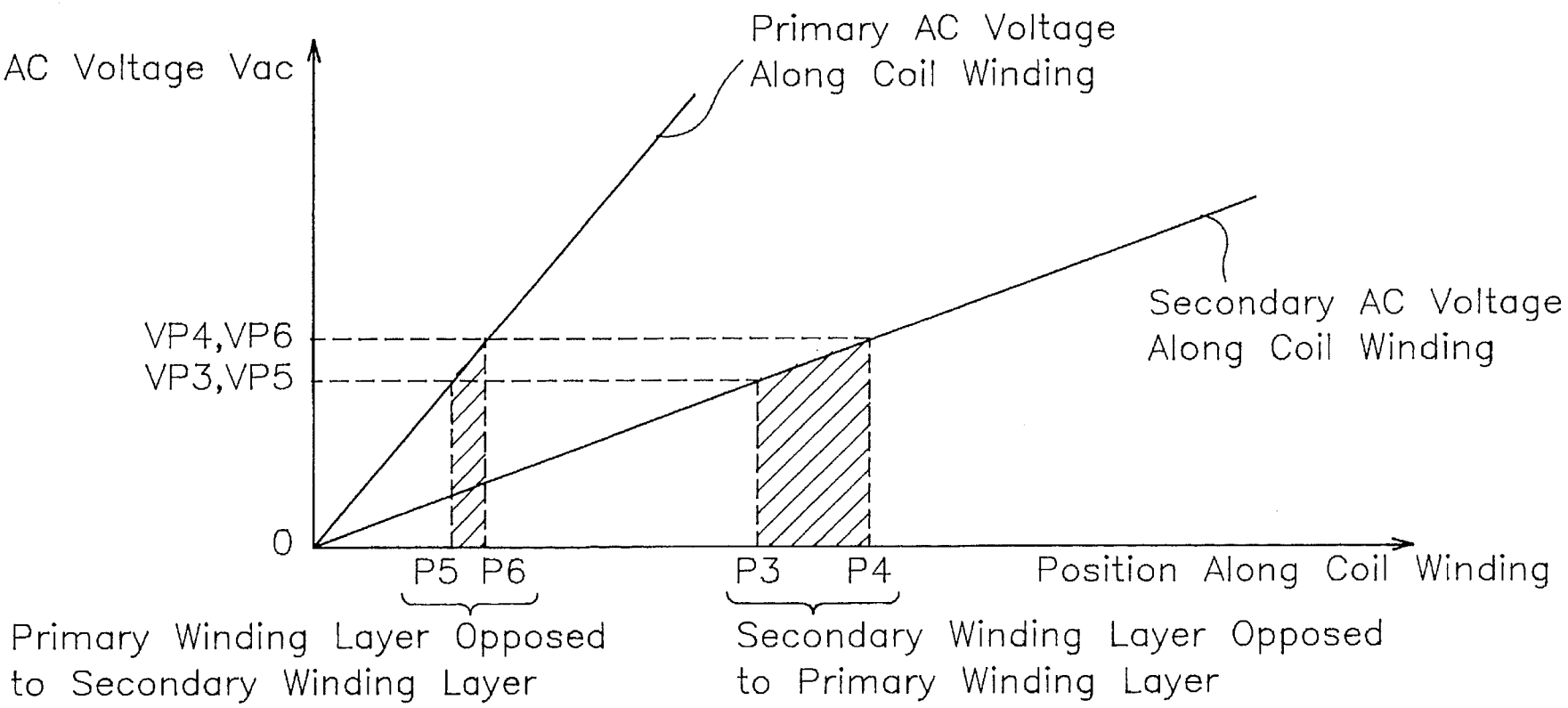
FIG. 27 is a graph depicting the relationship between the number of windings of each winding and the AC voltage for the circuit of FIG. 25.

FIG. 27 shows the relationship between the number of windings of each winding and the AC voltage, wherein AC voltage Vac, induced corresponding to positions along the coil winding, increases on the secondary coil 20. Assuming that a voltage of secondary winding layer opposed to the primary coil is Vp3 at tile starting terminal P3 and is Vp4 at the ending terminal P4, then, the voltage of the secondary winding layer opposed to the primary winding layer is in the range Vp3 to Vp4. For the primary coil 10, the voltage of the primary winding layer opposed to the secondary winding layer (Vp5 to Vp6) is predetermined to coincide with the voltage of the secondary winding layer opposed to the primary winding coil (Vp3 to Vp4). Preferably, if the shape of the conductor pattern formed on the layer of the secondary coil 20, which is opposed to the primary winding layer, and the shaped of the conductor pattern formed on the layer of the primary coil 10, which is opposed to the secondary winding layer, have a mirror image relationship, the, the voltages induced on the secondary winding by the AC voltage applied to the primary winding will coincide at the opposed layers.

Although only one conductor layer is shown in primary coil 10 and secondary coil 20, in the above embodiments, several layers of planes are stacked together and winding ratio is determined corresponding to the desired converting voltage ratio of a DC—DC converter used therein.

As described above, according to the third embodiment, third coil 70 is inserted between the primary coil 10 and the secondary coil 20 and is grounded on the primary side, and voltage of the conductor pattern of the third coil is predetermined to coincide with voltage induced on the conductor pattern of secondary coil 20, so that no noise current, such as caused otherwise by AC potential difference, flows, and high shielding effect is obtained.

The foregoing embodiment is illustrative of the principles of the invention. Numerous extensions and modifications thereof would be apparent to the worker skilled in the art. All such modifications and extensions are to be considered to be within the spirit and scope of the invention.

What is claimed is:

1. A printed coil comprising:

a plurality of conductor forming planes, on each of which a conductor pattern having one or more turns is formed centered about a core inserting hole, and laminated together with an insulating layer;

each of said conductor forming planes being provided with outer peripheral connecting holes provided on an outer periphery of said conductor pattern, and inner peripheral connecting holes provided on an inner periphery thereof, said outer and inner peripheral connecting holes of said plurality of conductor forming planes being connected to said conductor pattern;

a connecting coil forming plane on which a conductor connecting pattern is formed and laminated together with said laminated conductor forming planes, said connecting coil forming plane being provided with outer peripheral connecting holes and inner peripheral connecting holes, said outer peripheral and inner peripheral connecting holes of said connecting coil forming plane being connected to said conductor connecting pattern; and means for electrically connecting said outer and inner peripheral connecting holes of said conductor forming planes and of said connecting coil forming plane; wherein said conductor connecting pattern of said connecting coil forming plane is selectively formed so that together with said means for electrically connecting at least one selected configuration of magnetically coupled combination of turns is selectively formed of said conductor patterns of at least two of said conductor forming planes.

2. The coil of claim 1, wherein said turns of one of said conductor patterns of one of said conductor forming planes comprises a primary coil, which functions as a primary winding of a transformer, and said turns of another of said conductor patterns of another of of said conductor forming planes comprises a secondary coil which functions as a secondary winding of said transformer.

3. The coil of claim 2, wherein said primary coil (10) comprises two units; and wherein said secondary coil (20) is disposed between said two units.

4. The coil of claim 2, wherein said secondary coil (20) comprises two units; and wherein said connecting coil (60) is disposed between said two units of said secondary coil.

5. The coil of claim 3, wherein the connection pattern (61) of said connecting coil (60) connects in series the conductor pattern on each of said plurality of conductor forming planes which forms the primary coil.

6. The coil of claim 2, wherein the outer and inner peripheral connecting holes on said plurality of conductor forming planes and on said connecting coil are formed as two groups, one group being disposed on one side of said core inserting hole and the other group being disposed on another side of the core inserting hole; and wherein the one side and other side are allocated for placement of the primary coil and the secondary coil of a transformer.

7. The coil of claim 2, wherein the shape of said plurality of conductor forming planes and said connecting coil is rectangular; wherein the outer peripheral connecting holes are disposed along two opposing sides of said rectangular shape with the outer peripheral connecting holes disposed on one side being connected to outside connecting terminals (P11, P13) of a primary coil, and with the outer peripheral connecting holes disposed on the opposing side being connected to outside connecting terminals (P21, P23) of a secondary coil.

8. The coil of claim 1, wherein a winding direction of said conductor pattern on each of said plurality of conductor forming planes is the same.

* * * * *